US006922863B2

(12) United States Patent
Giori et al.

(10) Patent No.: US 6,922,863 B2
(45) Date of Patent: Aug. 2, 2005

(54) ADJUSTABLE FOAM MATTRESS

(76) Inventors: Gualtiero G. Giori, 8540 Belle Meade Dr., Fort Myers, FL (US) 33908; Janine Giori, 8540 Belle Meade Dr., Fort Myers, FL (US) 33908

( * ) Notice: Subject to any disclaimer, the term of this patent is extended or adjusted under 35 U.S.C. 154(b) by 0 days.

(21) Appl. No.: 10/244,456

(22) Filed: Sep. 17, 2002

(65) Prior Publication Data

US 2003/0009830 A1 Jan. 16, 2003

Related U.S. Application Data

(63) Continuation-in-part of application No. 10/016,722, filed on Oct. 30, 2001, now abandoned, which is a continuation-in-part of application No. 09/800,752, filed on Mar. 7, 2001, now abandoned.

(51) Int. Cl.[7] ..... A47C 27/10

(52) U.S. Cl. ..... 5/709; 5/710; 5/655.3; 5/953

(58) Field of Search ..... 5/709, 710, 420, 5/740, 953, 654, 655.3

(56) References Cited

U.S. PATENT DOCUMENTS 3,872,525 A * 3/1975 Lea et al. ..... 5/671
4,371,997 A * 2/1983 Mattson ..... 5/709
4,766,628 A * 8/1988 Walker ..... 5/706
4,838,309 A * 6/1989 Goodwin ..... 137/554
5,033,133 A * 7/1991 Nissen ..... 5/653
5,159,726 A * 11/1992 Bloch et al. ..... 297/284.2
5,634,225 A * 6/1997 Miller et al. ..... 5/710
6,038,722 A * 3/2000 Giori et al. ..... 5/709
6,092,249 A * 7/2000 Kamen et al. ..... 5/653
6,269,505 B1 * 8/2001 Wilkinson ..... 5/713

* cited by examiner

*Primary Examiner*—Heather Shackelford
*Assistant Examiner*—Fredrick Conley
(74) *Attorney, Agent, or Firm*—William E. Noonan

(57) ABSTRACT

The invention modulates the air volume in foam cores of cushioning support devices and any other support apparatus using foam or similar materials. The foam core can be incrementally modulated to realize an infinite number of comfort levels as to softness and support firmness. The core consists of self-inflating open-cell flexible polyurethane foam and is completely sealed within an enclosure fitted over it, with one or more valves installed in the side walls which communicate with the outside air. Through the valves air is selectively withdrawn from the foam core, allowing the foam's density to increase. The invention uses relatively inexpensive foam, but through air volume modulation achieves a tactile feel of supreme softness for the user, without giving up the necessary firmness to support the body, as happens with very soft foam (bottoming-out or hammock-effect). When air is extracted from a self-inflating foam core, the surface of the core will soften uniformly while maintaining its support firmness. Contrary to this, when pressure is exerted on, for example, traditional coil spring core mattresses, their surface will harden. Integral part of the invention is a device using balanced springs in valve assemblies to avoid compression set, an irreversibly solid state of totally air-depleted foam.

29 Claims, 22 Drawing Sheets

TRADITIONAL FOAM MATTRESS ON A BASE

PRIOR ART TRADITIONAL MULTI FOAM ZONES

PRIOR ART TRADITIONAL MULTI FOAM ZONES AND COIL SPRING MATTRESS 1410
1401
1411
V
1413
1408
1409
1411
1408
1409
1412

ADJUSTABLE FOAM MATTRESS

CROSS REFERENCE TO RELATED APPLICATIONS

This Application is a Continuation-In-Part of application Ser. No. 10/016,722 having a filing date of Oct. 30, 2001, now abandoned, which in turn is a Continuation-In-Part of application Ser. No. 9/800,752 having a filing date of Mar. 7, 2001 now abandoned.

STATEMENT REGARDING FED SPONSORED R & D (NONE)

Field of the Invention

The present invention teaches the modulation of the principal characteristics of open-cell, flexible polyurethane foam for use in support devices such as mattresses, sifting furniture, cushions and all other applications using a support apparatus. These characteristics are subjective tactile softness and bodyweight-carrying support firmness, the modulation of which is effected in a way so as to greatly enhance comfort and to offer an infinite choice of easily adjustable levels of comfort to the user at lower comparable cost. On its own, in combination with multi-chamber arrangements and also integrated with known, traditional techniques, this invention enhances the versatility of support devices, allowing for a great number of variations in the choice and adaptation of materials and mattress architecture to go together with self-inflating, modulable foam.

BACKGROUND OF THE INVENTION

This invention, in its simplest form is a mattress with at least one piece of self-inflating elastomeric open-cell polyurethane foam. Said piece is adjustable as to hardness and softness, measured in terms of Indentation Force Deflection (IFD, or spring-back force) and support (density).

Various attempts have been made to control the hardness, softness, and support of foam within a mattress. This has been achieved by adding different pieces or zones of foam within a mattress, each zone having a different density and IFD rating which corresponds to a body part such as head, shoulders, middle body, legs and feet. Yet other inventions have interchangeable foam components which the user may select and arrange as desired. This process is inconvenient, since bulky foam components have to be stored and manipulated very often to make the required changes.

The invention at hand does away with all these problems, since even in its simplest form a modulable foam core of only one piece will pressure adjust the heaviest and the lightest parts of the body respectively. Another dilemma with "foam zones" having different IFD ratings for different parts of the body, is that it is difficult to give adequate support to a very soft foam component. To achieve this, mattress manufacturers use a coil, foam base, or compressed air bases which are firm and offer needed support, subsequently they layer softer foams above said firm base to offer comfort. Nowadays most high-end quilted covers and pads that cover mattresses additionally contain a thin layer of visco-elastic foam for added comfort.

In recent years, we have seen the advent of higher density foams such as visco-elastic foam that solves the problem of support and softness combined in foam of one single piece. Visco-foam offers support because of its high density (typically over 3 pounds per cubic foot density) and feels soft and desirable to the user because it typically has an IFD of 15 or under. However, the high cost, bulk and heavy weight of a visco-foam core remains a problem. Companies, who sell visco-foam mattresses, are obliged to deliver and install them at the customer's home.

To address these difficulties through controlling softness and support of foam directly without a proportionately induced loss of support, and to reduce the weight and bulk of foam mattresses in the manner of this invention, has not yet been achieved and is not found in any prior art concerning support surfaces.

U.S. Pat. No. 2,779,034 to Arpin discloses a firmness adjustment for mattresses involving a standard coil spring mattress, wherein the springs are enclosed by a loosely fitting airtight cover. A vacuum pump can be applied to the outer cover in order to compress the coil springs within the mattress to make them harder. Although the disclosure of Arpin mentions 'rubber foam' or similar material, it does not involve any open-cell, self-inflating foam varieties, nor does Arpin teach that the respective density and IFD values, which are determined by the cellular structure of the foam or foam-like material he may have had in mind, may be modulated to result in a softer or harder mattress without sacrificing support-firmness in the process of multiple comfort adjustments. The present invention, however, achieves exactly this effect, to name, increasing softness without decreasing support firmness to the same degree. It breaks the link that a fixed value of softness must automatically entail an equally fixed value of support firmness. As softness is increased, support firmness is not decreased to an equal degree, giving the user a feel of a high density foam such as visco-elastic foam. Arpin discloses a method of increasing the firmness of metal coil springs by compressing these, which does not increase comfort.

U.S. Pat. No. 3,611,524 illustrates a method of assembling a mattress. The disclosure involves a ready-made mattress either of the coil spring type or foam type which is initially wrapped in an airtight sheet of plastic. Then a vacuum pump is applied to the wrapped combination and the coil spring or foam mattress collapses under the force of the vacuum and can be inserted into a finishing cover. Once the vacuum in either mattress is released, they will expand to snugly fit in the outer cover. This invention is designed for a one-time use only. Moreover, there is a teaching within this reference that the preliminary wrapping sheet should be removed. In contrast to this, the invention at hand can be used time and time again to adjust the various levels of firmness desired. No disclosure within U.S. Pat. No. 3,611,524 is made that the aim of the process is to adjust comfort levels. It is a manufacturing process.

U.S. Pat. No. 3,872,525 to Lea discloses a camping mat using a self-inflating foam within an airtight outer cover that is vulcanized to the inner foam core. The air within can be removed by compressing the structure. The foam core collapses so that the mat can be rolled up into a compact package. Firmness (IFD) or density can not be modulated freely because of the thinness and light weight of the foam core used in camping mats. Furthermore, compressing the camping mat by hand does not expel the air uniformly from all the foam cells but only in the area which are compressed by hand. Modulating comfort and firmness were not in the mind of the inventors, but a method of decreasing the mat's volume for easy packing and transport The invention at hand uses a thicker, higher density foam core to start with, which can be adjusted infinitely to multiple levels of firmness and support, not found in the prior art. It does not concern itself primarily with packaging a camping mat into a small size to be carried in a backpack, but with comfort modulation.

U.S. Pat. No. 4,025,974 discloses a self-inflating air mattress/mat including an airtight flexible envelope which encloses a core of resilient, open-cell, lightweight foam material, substantially the entire upper and lower portions of which are bonded to the envelope. Heated platens are applied to this lay-up, followed by creating a vacuum in the interior, cooling and pressurizing the assembly, then moderately pressurizing the whole. The invention at hand does not bond outer coverings to the enclosed foam core. On the contrary, it uses an air permeable device to distance the foam from the cover in order to enhance airflow and to prevent the foam core or cover from obstructing the valve when air is drawn out of the mattress with a vacuum or when it is self-inflating.

The aim of cited teaching is to compress the mat for easy transport in a backpack. There is no indication of a further objective to intentionally modulate the foam density or IFD within the foam core with the aid of a vacuum to obtain multiple levels of firmness and support. Lastly, Lea proposes to utilize foam types with a density not greater than 1.2 or 1.5 in their original state.

U.S. Pat. No. 4,711,067 teaches the packaging of a mattress wherein the thickness of an elastic structure of a mattress is reduced. An extra cover is laid over the mattress which is fitted over the structure of a pressing device. This procedure will completely flatten the mattress for roll-up. This is a packaging process, not a disclosure to control comfort levels and to apply a vacuum pump to do so.

U.S. Pat. No. 4,944,060 illustrates a mattress having a plurality of discrete, airtight cells which are to some extent hydrophobic. In contrast to the invention at hand, there is no block of foam core, no covering encasing or envelope and there is no teaching of complete air evacuation.

U.S. Pat. No. 4,711,067 has been granted to a method of packaging a single mattress to a small size so that it can be conveniently carried. It includes the steps of inserting a single mattress into a flexible and waterproof wrapper, compressing it by squeezing it with a compressing device to reduce its thickness within limits and compatible with the its elastic structure and driving out air. The wrapper can be sealed and the whole unit can be inserted in a container for shipping. At the point of sale the mattress is allowed to expand. No mention is made of modulating comfort levels or creating a vacuum. This is a packaging method.

U.S. Pat. No. 4,944,060 discloses a mattress assembly that includes a base support, a mattress core disposed on the support and a plurality of discrete air permeable hydrophobic air cells. A pump or other suitable means is used for directing an airflow through a number of controllable valves to and through the cells, pressurizing the mattress.

The invention at hand does not use pressurized air but a vacuum pump only, whereas the above art teaches the opposite, namely pressurization of a chamber to increase the hardness of the support surface. The problem with pressurized air supported surfaces is that if air were allowed to escape the pressurized chamber, the support surface would collapse and cause a hammock effect. In the invention at hand adjustable foam does not display a collapsing hammock effect when air is removed from the foam cells, but adjusts to the body's pressure points locally as density within the foam core increases to offer more support.

U.S. Pat. No. 5,947,168 illustrates a method and apparatus for rapidly deflating and substantially emptying an inflatable air chamber, the chamber being a mattress. This disclosure does not involve self-inflating polyurethane foam with alternating density or IFD and is not relevant to the invention at hand.

U.S. Pat. No. 6,098,378 discloses a method of packaging a single mattress into a small size to be conveniently carried. The foam mattress is compressed to fit into a hard container for shipment and is extracted at the point of sale to expand to its original shape. This appears to be a one-time use only and there is no teaching of adjusting the comfort level of a user through modulation of an inner vacuum.

SUMMARY OF THE INVENTION

The present invention teaches how to control and modulate the principal characteristics of open-cell flexible polyurethane foam in a specific integration with airtight covers and pressure valves for the use in any form of comfort support device, for instance, mattresses. The principal characteristics pertain to industry standards of subjective tactile softness in the sense of espousing body contours so as to optimally distribute pressure points of a person reclining on a planar surface, and of bodyweight-carrying support firmness. They are controlled and modulated in a way to not only greatly enhance comfort, but particularly to offer an infinite choice of easily adjustable levels of comfort, defined as a balance between softness and firmness. This is done at lower comparable cost and weight compared to high density foam varieties such as visco-elastic foam, and in combination with known, traditional techniques, it enhances versatility, allowing for a great number of variations in the choice and adaptation of materials to go together with self-inflating, modulable foam into comfort level adjustable support devices.

The invention teaches how the Indentation Force Deflection (IFD) and density properties of a certain quality range of flexible open-cell polyurethane foam are modulated by removing some of the air from within the foam cells and altering the cellular density of the foam core. Since high density, more expensive foams, such as visco-elastic foams, are very desirable as to comfort, the principal teaching of the invention is how to modulate comparatively less expensive, lower density foam to exhibit the feel-characteristics of high density foam, and also attain support and comfort levels of a higher density, more expensive foam, without locking the user into a single, fixed comfort level.

IFD and density modulation are achieved by altering open-cell, flexible polyurethane foam or material of similar characteristics within a fixed framework of controllable valves and airtight bladders. This art teaches that the material is fashioned in a particular form and that it is of a molecular composition as to permit the extraction of air in the alveolate structure in a uniform manner throughout, thus increasing material density equally uniformly. A further specialty of the material is that, by virtue of its structure, particular manufacturing and finishing processes, it affords in its low IFD number modulated state a commensurably higher support stability, heretofore only associated with foam or similar material of a very much higher density and greatly higher price. Finally, it is much lighter in weight than the latter and can also be reduced in size and volume for easy transport and storage.

The application of the principles of this teaching extends to a great number of possible combinations of foam only and foam plus traditional support devices used in the architecture of, for example, mattresses, that users may adjust to their personal preference. But in all its combinations, the pivotal point of the invention is that specifically fashioned types of foam will soften when air is extracted from their cell structure. Compared to its original firmness, which is indicated by the manufacturer's IFD number, its resilience will decrease to about half of its original value. The density on the other hand increases considerably to about double its original value, creating the much needed body support a mattress should have. Density of foam is its weight per cubic foot, hence the heavier a cubic foot of foam weighs, the higher will be its density rating.

The present invention teaches that removing air from a foam core uniformly reduces the volume of the core, hence increases its density without adding weight to the overall mattress, which would be undesirable for the user. One of the disadvantages of high density foams, such as visco-elastic foam, is that they are very heavy and difficult to fashion in the form of a mattress. In this invention the single foam core mattress as well as its combination with other bedding materials are much lighter of weight but yet exhibit the same comfort and support characteristics as, for instance, a visco-elastic mattress. It has the additional advantage of being adjustable. Removing air from visco-elastic foam or similar materials in the same manner is not possible, because their cellular structure is very tight and would solidify almost immediately (densification).

The following is a description of how a polyurethane foam core changes in this present invention, demonstrated on a sample of a twin-size mattress foam core. Such a sample typically contains a volume of about 13 cubic feet of air, has an initial density rating of 1.2 and an IFD number of 40, corresponding to a relatively firm-surface foam weighing 15.6 lbs. In comparison, visco-elastic foam of the same size would generally weigh about 58 lbs.

To effect the change in the sample, a fan-style vacuum generator is connected to an outer airtight cover, drawing approximately 0.6 cubic feet of air per second. At this rate it takes 3.5 seconds to double the foams density and to reduce the IFD value so that it feels like a 2.4 density high resilient foam with an IFD value of about 22. The vacuum pump is equipped with variable speed control and remote control memory settings, so that the user can either set or recall a previous setting of an individual comfort level at the speed and in increments which suit him. In laboratory experiments, a user was made to recline on the foam in it's original configuration. He then adjusted the density and IFD settings within the foam core. It was observed that the user's heaviest body-parts sank into the foam and were contoured progressively as the density increased and the IFD value decreased. No collapsing of the mattress, bottoming-out or hammock effect occurred. If no air were allowed to re-enter the foam core and the user were to be lifted off it, the negative mould of his body with all corresponding heavy and light pressure points would be imprinted in the foam permanently.

The second point of importance to be noted is that the foam core gains in stability when air is removed, as opposed to an air chamber which would simply deflate and become wobbly, that is, unstable. In laboratory experiments a further point has been addressed, dealing with the undesirable characteristic of open-cell flexible polyurethane foam to solidify in a full vacuum-state, the so-called 'compression set' (CS). If too much air is removed from the cellular structure of foam, it will harden in its densest state and subsequently no longer be able to self-inflate and regain its loft, even partially. CS becomes critical when foam has been compressed for an extended period of time. If, however, a residual amount of air could be left in a foam core and be controlled, it would not suffer CS nearly as much as opposed to a fully deflated foam core.

The chamber's vacuum in this example is controlled by valves which operate under spring pressure. When air is evacuated from a self-inflating foam core within a hermetically sealed cover, the foam material's cellular elasticity exerts pressure to expand to its original form by drawing air back into its open cells, developing a measurable suction force. The more air is removed from the foam cells, the higher the foam core's re-inflation force. Springs in the valve assemblies connected to the partially emptied chamber oppose the re-inflation force reciprocally. Hence a balance between the opposing forces can be established, depending on the spring force and the suction force. Tests conducted in a laboratory environment show that CS can be prevented in a totally deflated foam core if the re-inflating force is slightly greater than the closing force of the valve spring. In this manner, air is drawn back into the mattress at a very slow rate, and stops entering the mattress when the re-inflation force of the foam equals the compression force of the spring in the valve. A fixed spring-force setting, allowing foam to re-inflate to a specific degree greatly reduces the occurrence of CS and preserves the deflated product from malfunctioning when allowed to re-inflate after extended storage periods. The principle of residual air retention to off-set CS has been validated in laboratory experiments for polyurethane foam used in a wide variety of mattress architectures, be it by itself or in a combination with other arrangements. To balance the closing force of the valve spring within the valve assembly against the re-inflating force of the various foams, a great number of specific compression values are being used to adapt to foams having different IFD and density ratings.

Thus, controlling compression set forms integral part of the invention, which would not be able to perform satisfactorily over long periods of time if intentional or accidental excessive deflation took place, destroying the specific characteristics of open cell, flexible polyurethane foam, which are the basis of comfort level adjustment.

Foam Core Configurations

A number of configurations in conjunction with various types of mattress architecture can be established. They are divided into types which use the characteristics of foam only, and types which use the characteristics of foam in combination with traditional support materials, the latter class being subject of a separate patent and not taken into account here. The following list concerns purely foam types and, as such, it is not exhaustive:

- The Single foam piece forming a foam core within one airtight autonomous chamber.
- More than one foam pieces forming a single foam core, within one autonomous airtight chamber.
- More than one autonomous airtight chamber containing foam cores arranged so as to be modulated independently for different body-parts.
- Several airtight autonomous chambers may be separated from each other internally by a flexible partition acting as a divider.
- Several airtight autonomous chambers may be arranged side-by-side and divided externally by a connecting element such as zipper, hook and loop, or snaps. Said airtight chambers may also be interconnected by welding.

DETAILED DESCRIPTION OF THE INVENTION

The aim of the description of this invention is twofold: to show that modulation of air volume within the foam cells defeats the undesirable hammock effect and that it provides one or more sleepers with new, up to now unavailable variety in choosing his level of comfort.

Figure 0:
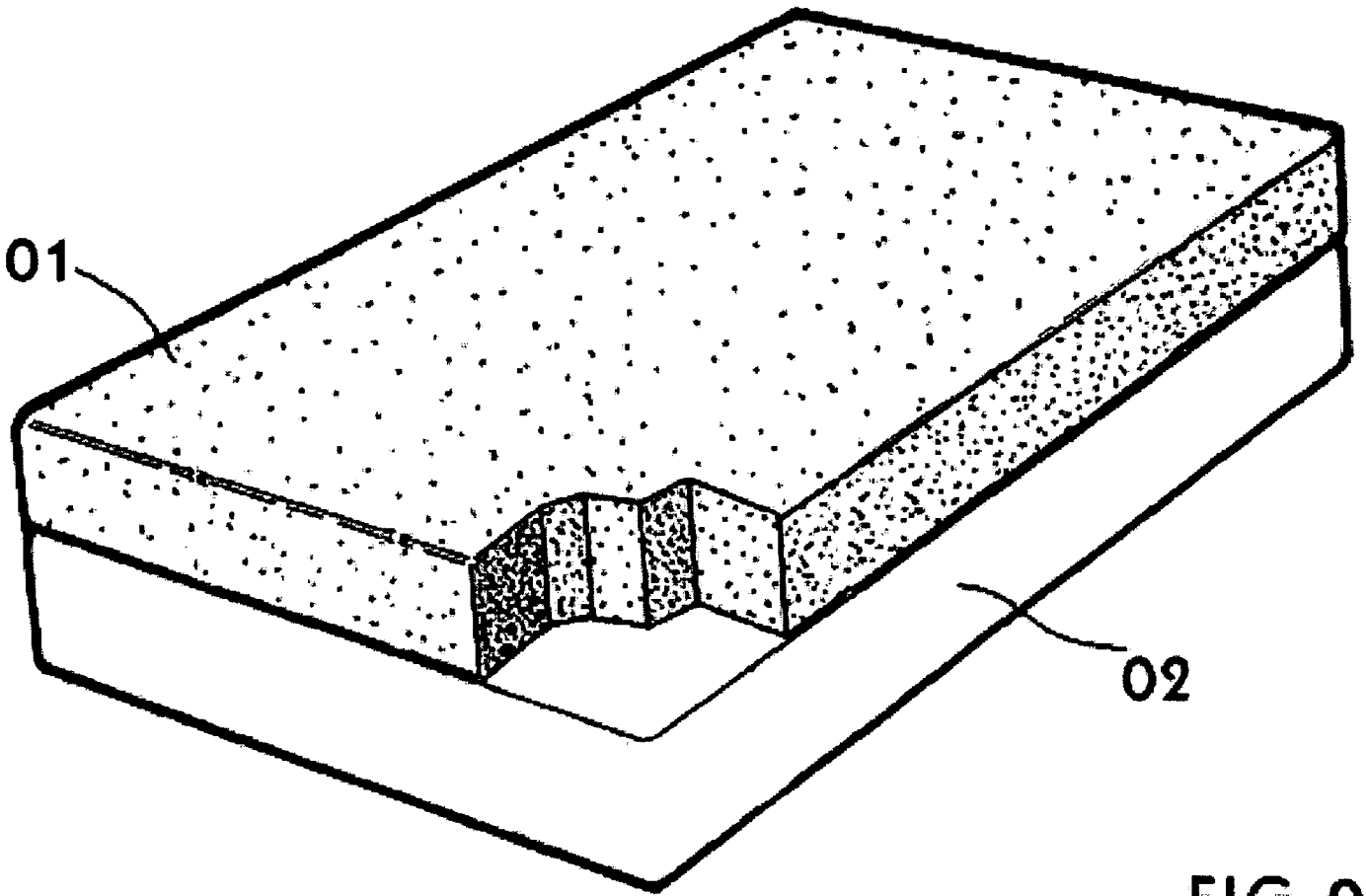
FIG. 0 shows a traditional foam core on a support base.

FIG. 0 shows a traditional foam mattress. One piece of foam (01) is placed on a support base (02), the support base traditionally contains coils, water, or air to support the above pieces of foam (01), or can be made of wood or other material as a solid frame.

Figure 1:
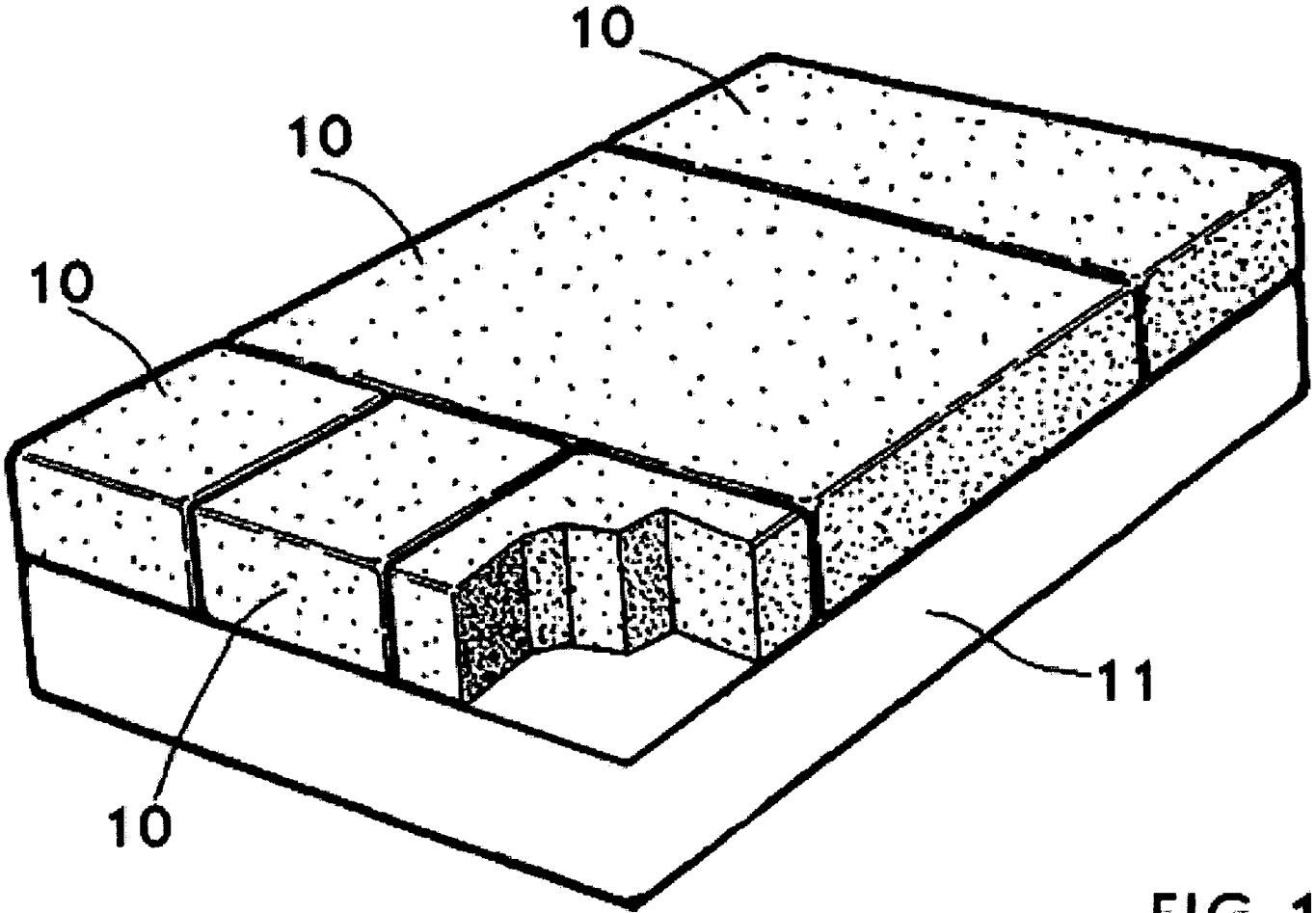
FIG. 1 shows various traditional foam cores, zoned on a support base.

FIG. 1 shows a traditional foam mattress with different foam cores (10) which have various IFD and density ratings. The purpose of using different foams is to accommodate parts of the body with different support characteristics. Again, the foam cores (10) may be placed on a support base (11).

Figure 2:
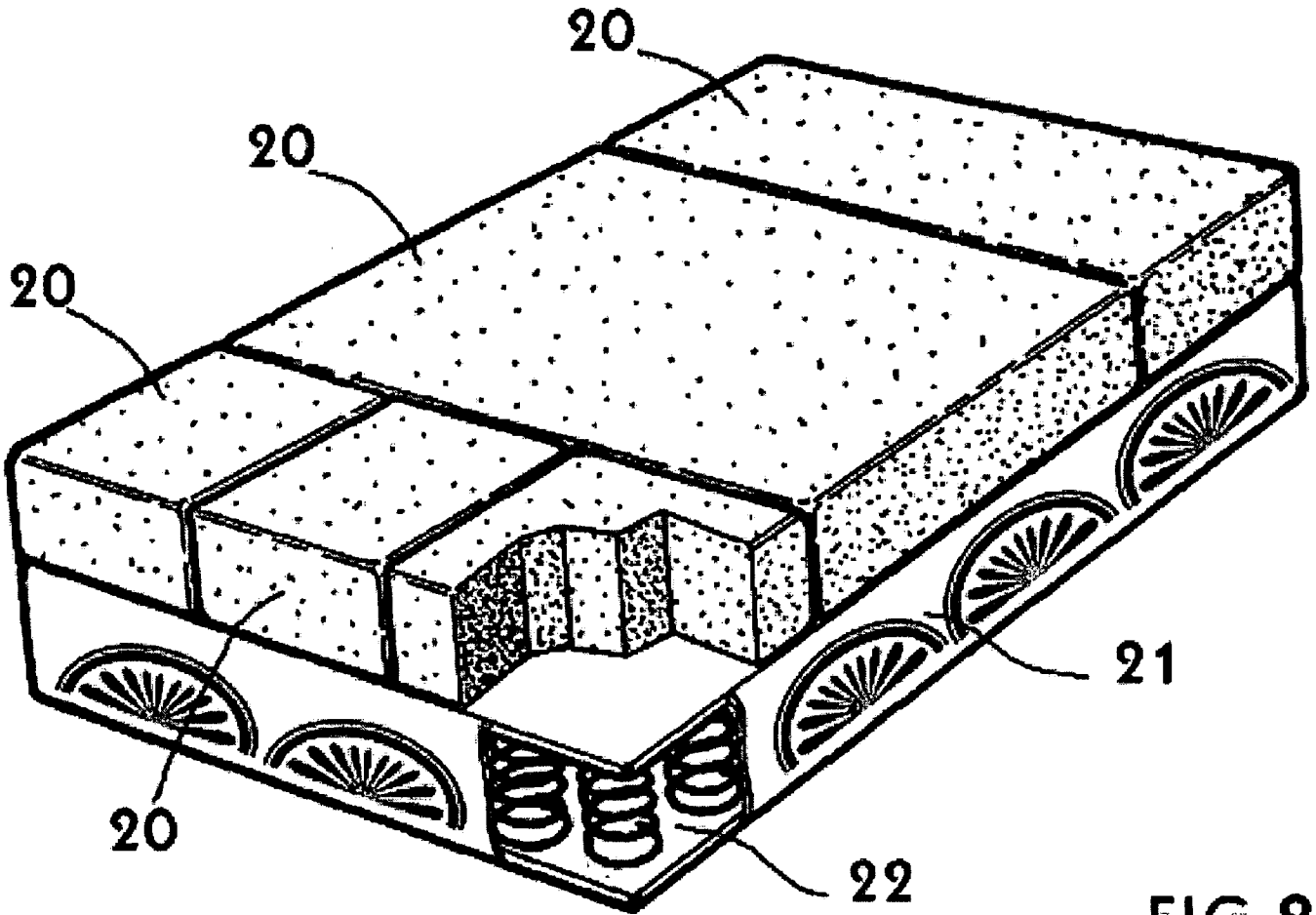
FIG. 2 shows various foam cores, zoned on a coil base.

FIG. 2 is a traditional sectional foam (20) and coil spring mattress (22). The coils offer a fixed rate of support which normally varies from firm to medium firm. The foam components also vary in IFD and density to accommodate different parts of the body respectively. The outer covering (21) is traditionally made of a quilted fabric which encloses the whole mattress and may contain additional soft layers of foam within the quilted cover on the top surface of the mattress. This traditional architecture locks the user into one fixed comfort level which cannot be modulated or changed as desired. Also, multi-foam zoned mattresses are typically very expensive, in any case more expensive than this invention.

Figure 3A:
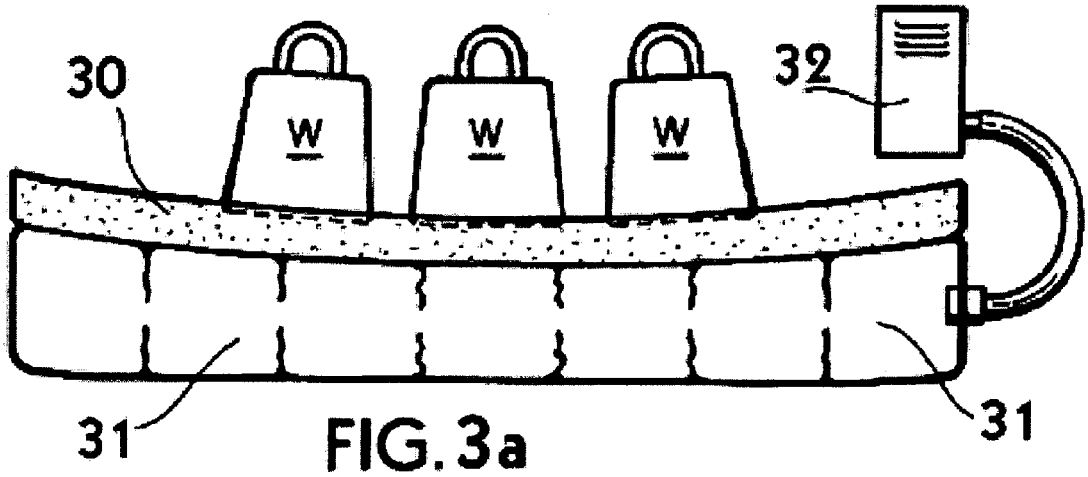
FIGS. 3*a* and 3*b* shows weights on prior art traditional mattresses.

FIG. 3*a* shows a typical prior art foam-piece-plus-air-chamber-mattress in which air bladders (31) can be pressurized by an air pump (32). The weights (W) represent a person reclining on top of the foam piece (30). The weights impress their mass on the mattress in the way a reclining person would, accumulating towards the area of least lateral support, that is, in the center. This results in a hammock effect, which is uncomfortable for a person resting on the mattress. Moreover, when air is let out of the bladder(s), the entire apparatus collapses and does no longer support the reclining body, the hammock effect being present all the way down through partial deflation. In this arrangement the air chamber is modulated below the above layered foam piece without any interactive effect on the foam. In case of loss of pressure, the air chamber wobbles and sways, rendering the structure unstable and even more uncomfortable. Moreover, by changing the air volume within chamber (31), the above layered foam piece (30) is not modulated; the density and IFD properties of this foam piece are not changing. Since a pressurized air bladder is not comfortable to recline upon, the foam piece (31) is placed on top of (30) for added comfort. In fact. In the present invention the user reclines directly on the foam core chamber being modulated, so the body's pressure points sink into the foam core chamber's outer surface directly and are contoured in a progressive manner depending on their weight.

Figure 3B:
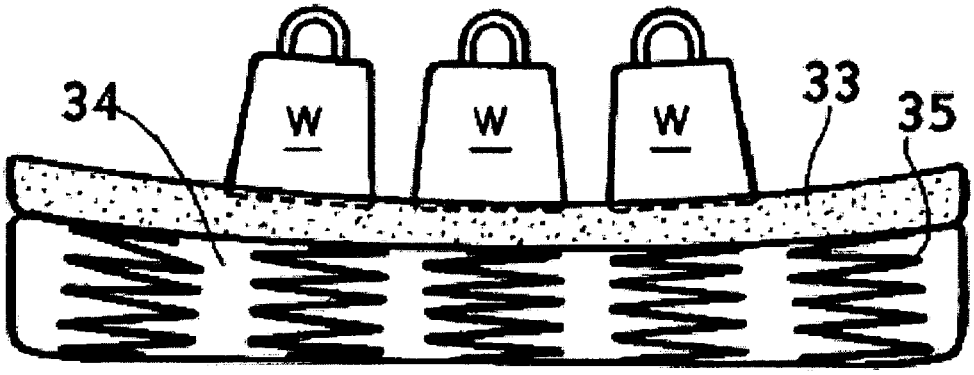

FIG. 3*b* shows the same configuration as FIG. 3*a*, but in a combination of a traditional mattress chamber (34) with coil springs (35), and a layer of foam (33) on top for additional comfort. The weights (W) represent a person reclining on the mattress and create the hammock effect in the middle, because their force is greater than both underlying bases of pressurized air and coil springs can support without deformation. Deform they must, otherwise they would have to be rock hard and uncomfortable, defeating the basic purpose of a mattress. Both types of base layers will spring back immediately as soon as the weights are removed or only partially displaced, exerting a high upward pressure. This characteristic is undesirable in a mattress, too, because each movement of weight, such as found in a typical person's sleeping pattern, shifts the hammock effect around on the mattress.

In contrast to the above, this invention modulates the density and the spring-back force (IFD) of self-inflating, open-cell, flexible polyurethane, thus doing away with these problems. Any weight distribution on top of such a foam mattress, such as from the head, abdomen or the legs, affects the deflection of the foam core surface only locally, and upward recovery (spring-back) is a slow process of re-directed airflow through the cell structure of the foam core. Consequently, no hammock effect will be in evidence.

Depending on the volume of air in the foam core, there can even be a state where no recovery takes place (as in very expensive memory foam); where no upward pressure is exerted by the foam core, and still a high level of comfort is sustained. This is based on the underlying principle inherent in the invention that, when air is removed progressively from a hermetically sealed foam core, the foam's density increases. At the same instance, its Indentation Force Deflection (IFD or spring-back force) is progressively decreased, making the foam core softer. This process of modulation spans from full inflation to practically zero. In the extreme case, when too much air is removed, the foam hardens, defeating the purpose of a mattress, e.g. to provide comfort.

From a different perspective, the totally deflated foam core, when allowed to re-self-inflate, also changes in density and IFD values incrementally as it regains its original factory pre-set state. The user can therefore modulate the foam core by removing some air with a vacuum pump, or by allowing air to re-enter the foam core which it does so naturally as the foam core recalls the air that has been removed from its cellular structure. Additionally, since the invention at hand uses foam cores that are at least 4 inches thick, the upward re-inflating force of the foam core is sufficient to lift a reclining person, so that the user may stop the modulation process when the desired body comfort is attained without ever getting off the mattress.

Figure 4:
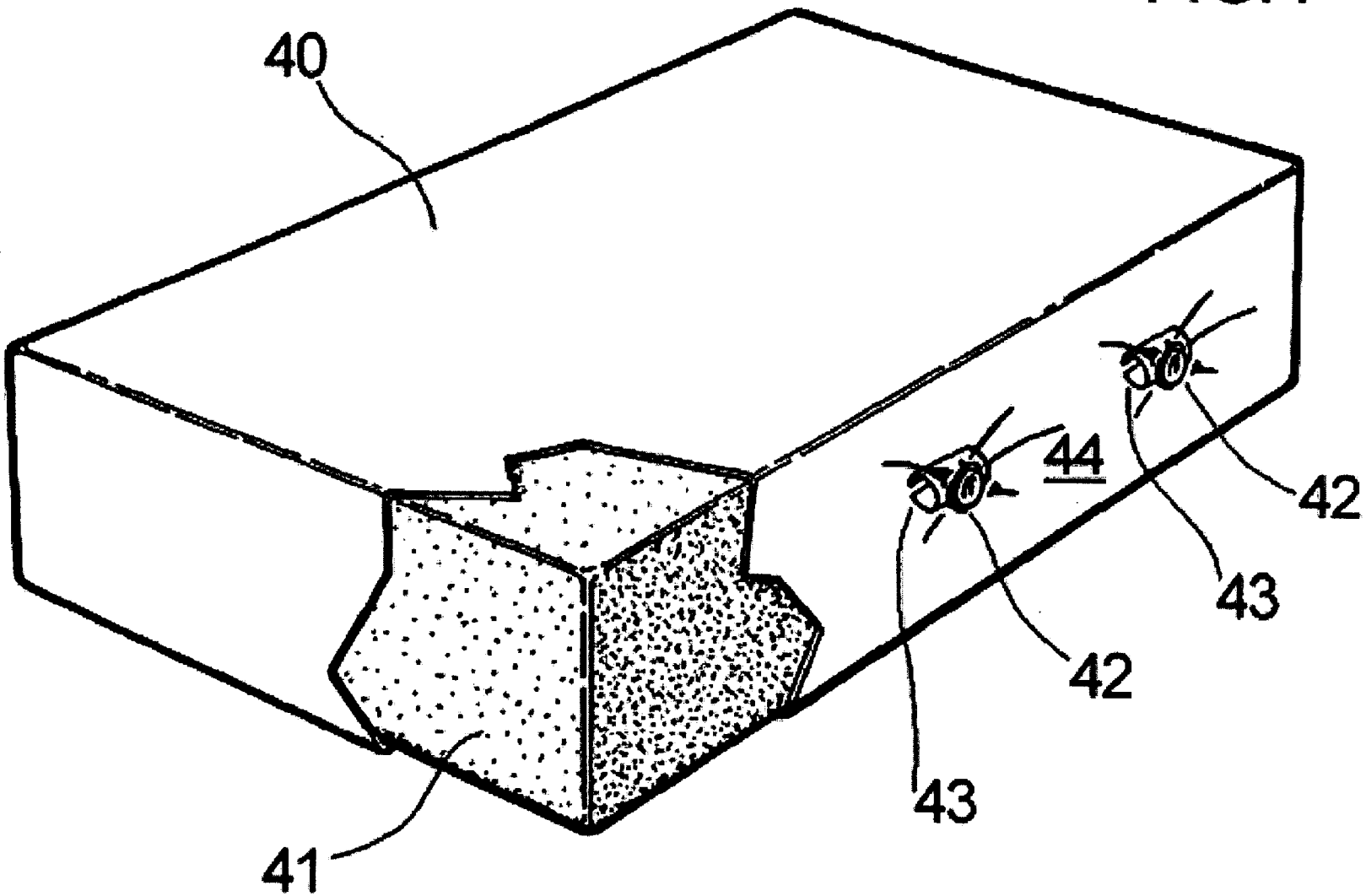
FIG. 4 shows a hermetically sealed, modulable foam core in its simplest form, one or more valves and a distancing element.

FIG. 4 shows one autonomous airtight chamber (40) and one foam core (41). Chamber (40) contains a self-inflating foam core (41) and is fitted with one or more valves (42), penetrating wall (44) of the chamber. The valves, when opened, either serve to let the core self-inflate rapidly or to evacuate some air, contracting the foam core(41) in a uniform manner and changing both its density and IFD values as the cellular volume of the foam cells changes. Air can be extracted with a vacuum pump (not shown) connected to the valves (42) which contain an air permeable distancing element (43). This element is essential to the proper functioning of the mattress and keeps wall (44) and valve (42) distanced from the foam core (41), hence permitting an effective airflow to and from the foam core.

As to the vacuum pump, no particular specifications are put forward for such an apparatus other than that it has to be efficient in extracting all air contained in the foam core. The utilization of a vacuum pump is stated here once and not repeated in subsequent descriptions of mattress configurations, but implied.

Figure 5:
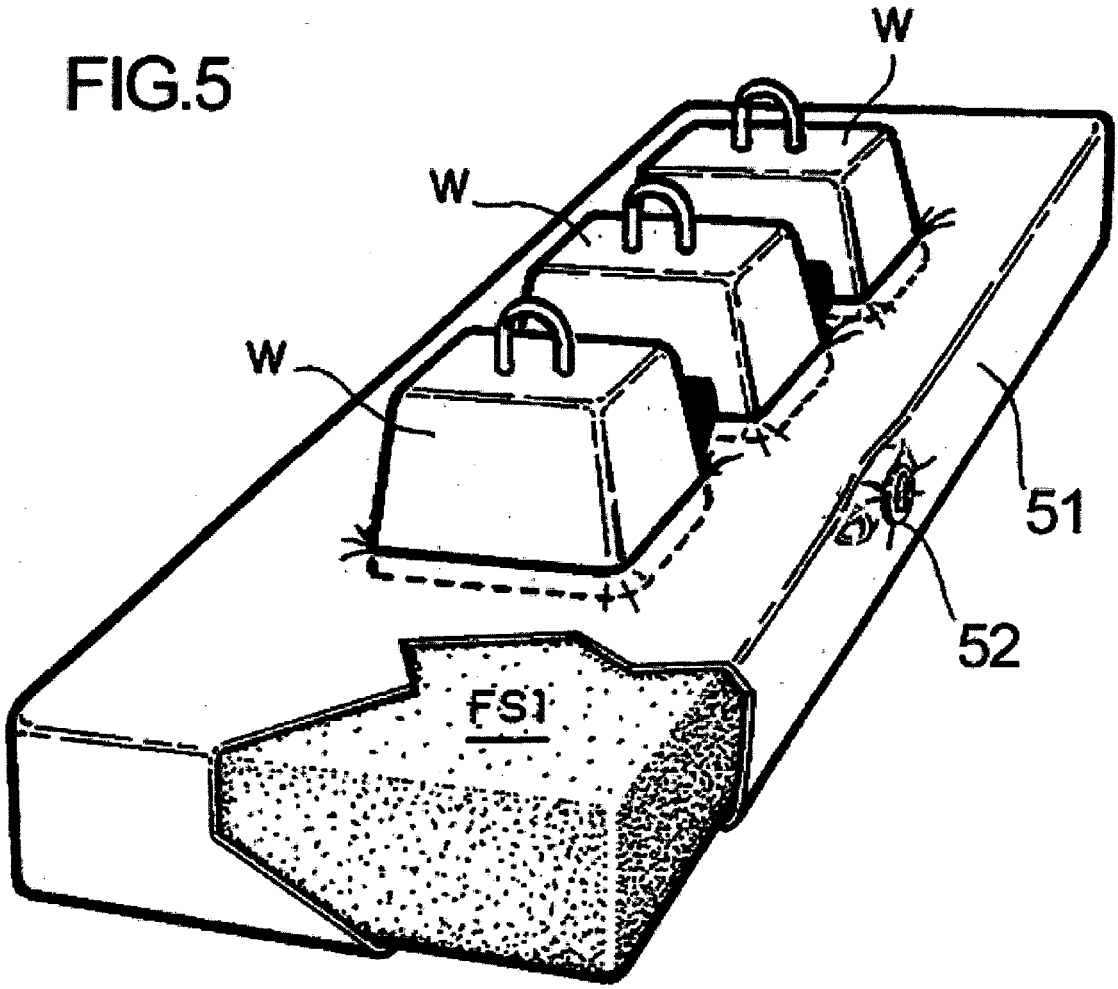
FIG. 5 shows the effect of pressure on a chamber containing a self-inflating foam core.

FIG. 5 shows the advantage of modulating a self-inflating, open-cell, flexible polyurethane foam core in support structures such as mattresses when weight is placed upon it. Compared to FIGS. 3*a* and 3*b* of traditional mattress architecture with coils and air chambers, the weights (W) are causing a quite different reaction or counter pressure. When they are placed on a partially deflated foam core (SF1), which is enclosed in a chamber (51) fitted with a valve (52), through which air can be evacuated selectively and uniformly, the foam core resists the pressure of the weights W without sagging (hammock-effect) and deforms at local pressure points only. If more air is evacuated from the core, the weights slowly sink deeper into the surface, still confined locally and precisely in the area where they are exerting downward pressure, without deforming adjacent areas. Because of an increase in density and a decrease of the IFD value within the foam, the surface will become softer and offer continuous support—unlike standard coil spring mattresses, where any weight deposited on the surface tends to tension and harden the coil springs, which want to return to their original, more relaxed state.

Figure 6:
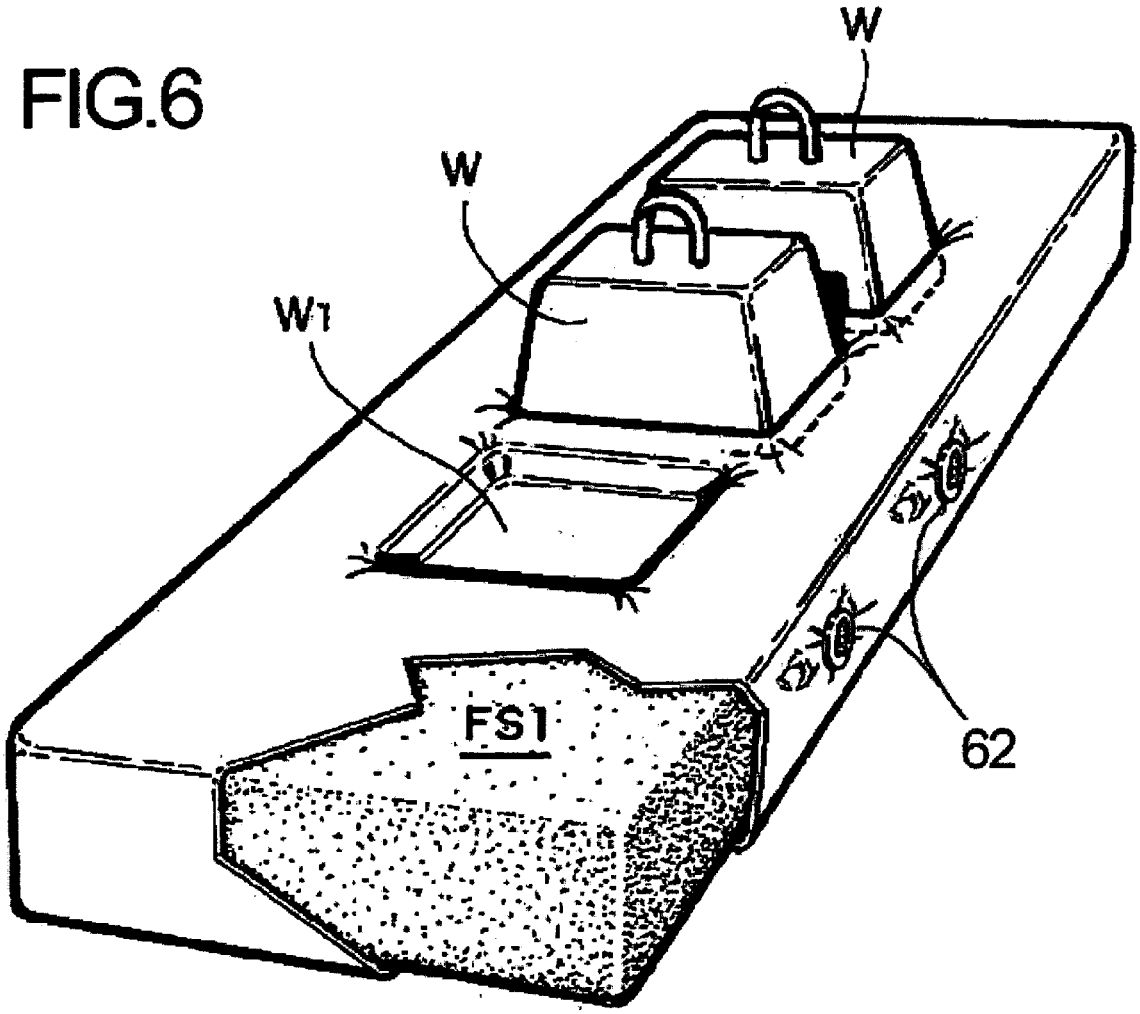
FIG. 6 shows the effect of removing weight from the core in FIG. 5

FIG. 6 demonstrates the effect with reference to FIG. 5. Foam core (FS1) is enclosed in a hermetically sealed chamber (as is shown in FIG. 4), from which some air has been uniformly removed, and the valve or plurality of valves (62) were then closed. The depressions on the top surface, where one of the weights (W1) has been removed, can still be seen, because the self-inflating foam recovers slowly, reacting to the reduction in pressure by rearranging the internal air distribution with a flow through its open-cell structure towards the indented area. If additional air were to be removed from the foam core, the depression (W1) would remain, because the resilience force of the foam cells in the depressed area would not be strong enough to extract air from the open-cell structure of the adjacent foam cells for an even distribution. In this state the foam core has a very reduced IFD and a greatly increased density, thus adopting the properties of a visco-elastic memory foam. This example can be translated directly to the effect of a person reclining on top of the foam core, as air is removed uniformly from the chamber. The heaviest pressure points of the body are modulated first, provided the foam core is fully enclosed. Any evacuation of air out of the core will result in a softer surface behaving in the manner shown in FIG. 6. For the invention at hand to perform in a satisfactory manner, foam cores should be at least 4 inches thick.

Figure 7:
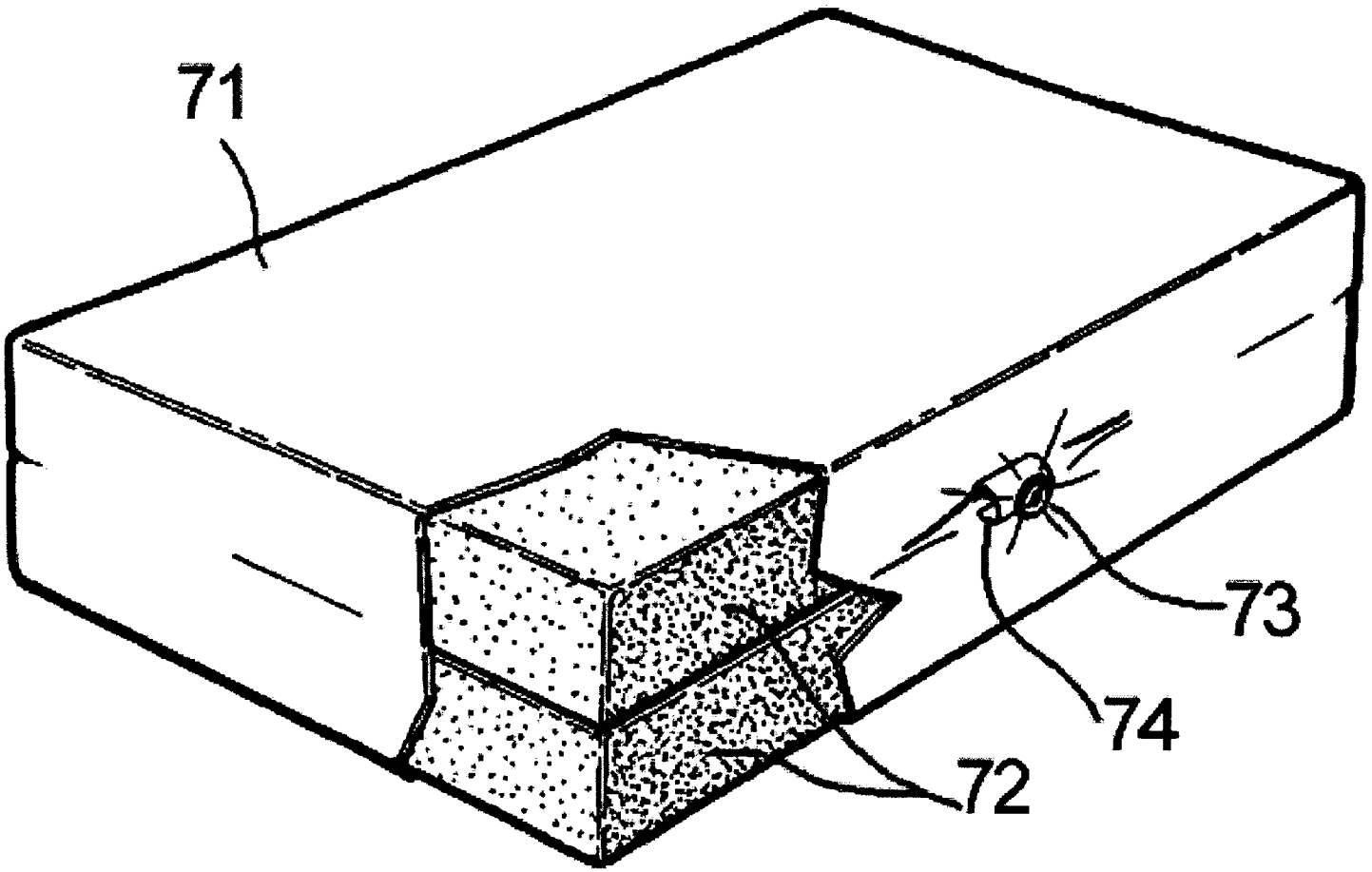
FIG. 7 shows one autonomous airtight chamber, one or more foam cores, a single valve and a distancing element.

FIG. 7 illustrates a mattress consisting of one overall autonomous airtight chamber (71) with two self-inflating pieces of foam (72) placed inside, one on top of the other, forming a single foam core. At least one valve (73) with air permeable distancing element (74) is fitted to the outer wall of chamber (71), through which air can be exhausted or admitted. When the valve is opened, air can be withdrawn from the chamber by means of a vacuum pump, which will change the air volume within the foam core. When the foam pieces (72) are compressed, their surfaces will soften as a result of decreasing IFD. Provided foam pieces are used with different factory pre-set density and IFD values, their characteristics will change differentially upon air evacuation. A harder pre-set foam on the bottom will soften less and provide more stability, while a softer preset foam on top will soften more readily under the conditions of an identical partial vacuum. More comfort modulation levels are thus provided to the user. The foam core in each chamber can be subdivided into two or more core pieces, each piece of foam may or may not have a different pre-set foam density. All foam pieces within the same core and in the same chamber will react differently on extraction of air.

Additionally, having multiple and diverse factory-preset foam pieces within a chamber, signifies that the user can choose which surface of the mattress he prefers to recline upon before any modulation takes place. Versatility is thus increased. Using, for example in the two chamber configuration, one or more foam pieces per chamber, it is possible to achieve a comfort modulation level of very soft to softer in the first chamber, and hard to very firm in the second chamber. For clarity's and brevity's sake, the possibility of using multiple core foam pieces per chamber and multiple chambers is implied in the subsequent descriptions of chamber configurations, and not limited to the present examples.

Figure 8:
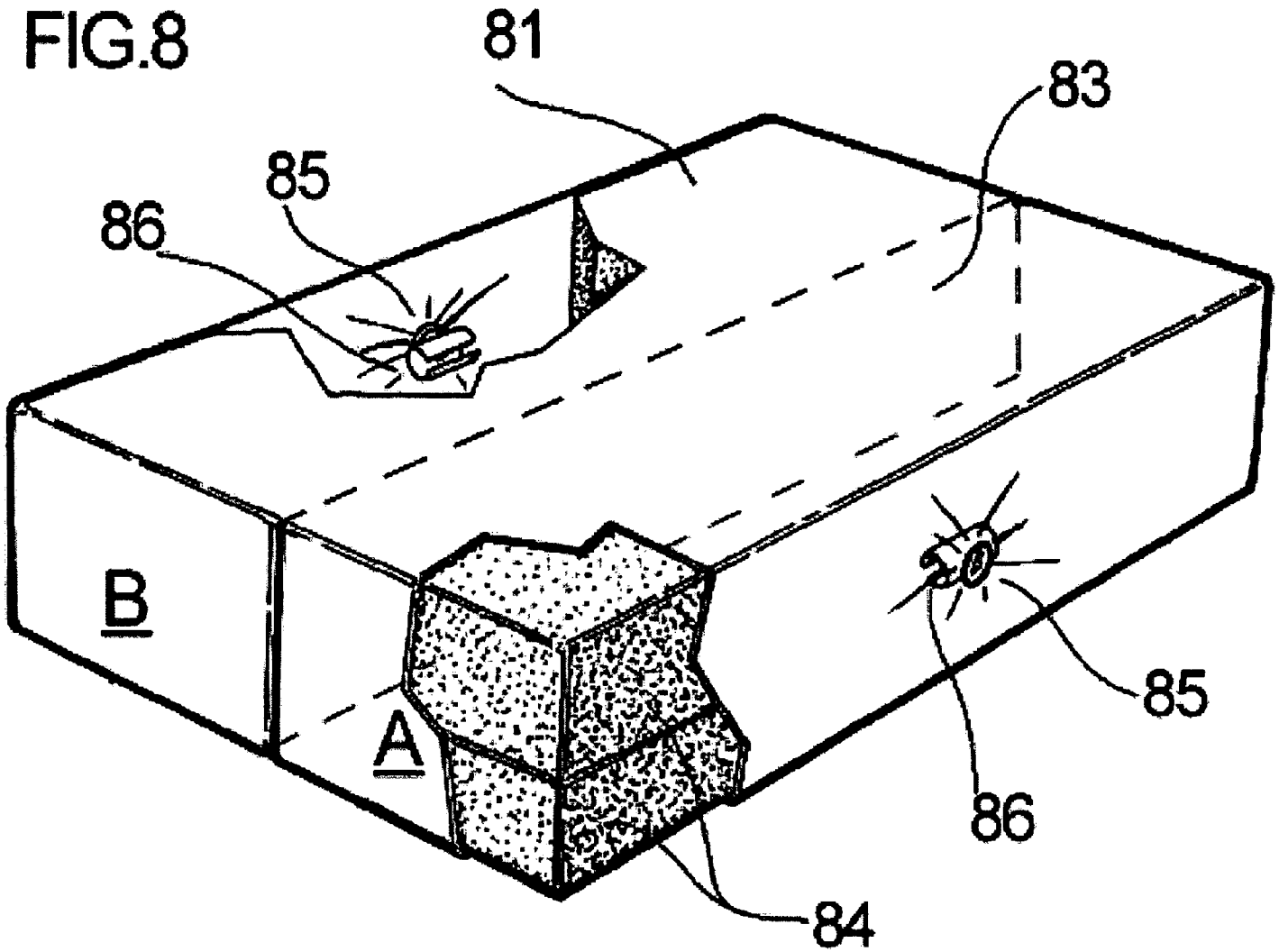
FIG. 8 shows two airtight autonomous chambers, one or more foam cores, an inner separation, two valves and two distancing elements.

FIG. 8 shows one outer airtight cover (81) which contains two separate autonomous chambers (A and B) which are separated by an internal airtight wall (83) and contain one or more self-inflating foam pieces (84). The chambers (A and B) are both fitted with one or more valves (85) to exhaust air selectively and independently from within the foam cores. The valves penetrate the wall (81) to the interior of their respective chamber and both have an air permeable distancing element (86) attached to their inward end to prevent foam or cover material from clogging the air passage. When the air is exhausted from the chambers selectively, the two cores increase in density, so there is no loss of support, and they will soften because of a decrease in IFD. They will do so differentially when foam types of a different factory pre-set density and IFD value are used, so that the foam in chamber (A), for example, can be independently modulated to give a harder surface feeling than the lower piece of foam or vice versa. On the other hand, when only the air is evacuated from the foam core of chamber (A), only this chamber will be rendered softer because the core (B) will remain unaffected. This mattress combination can be used on both sides, and is intended for use by two users who wish to modulate their own side of the bed selectively.

Figure 9:
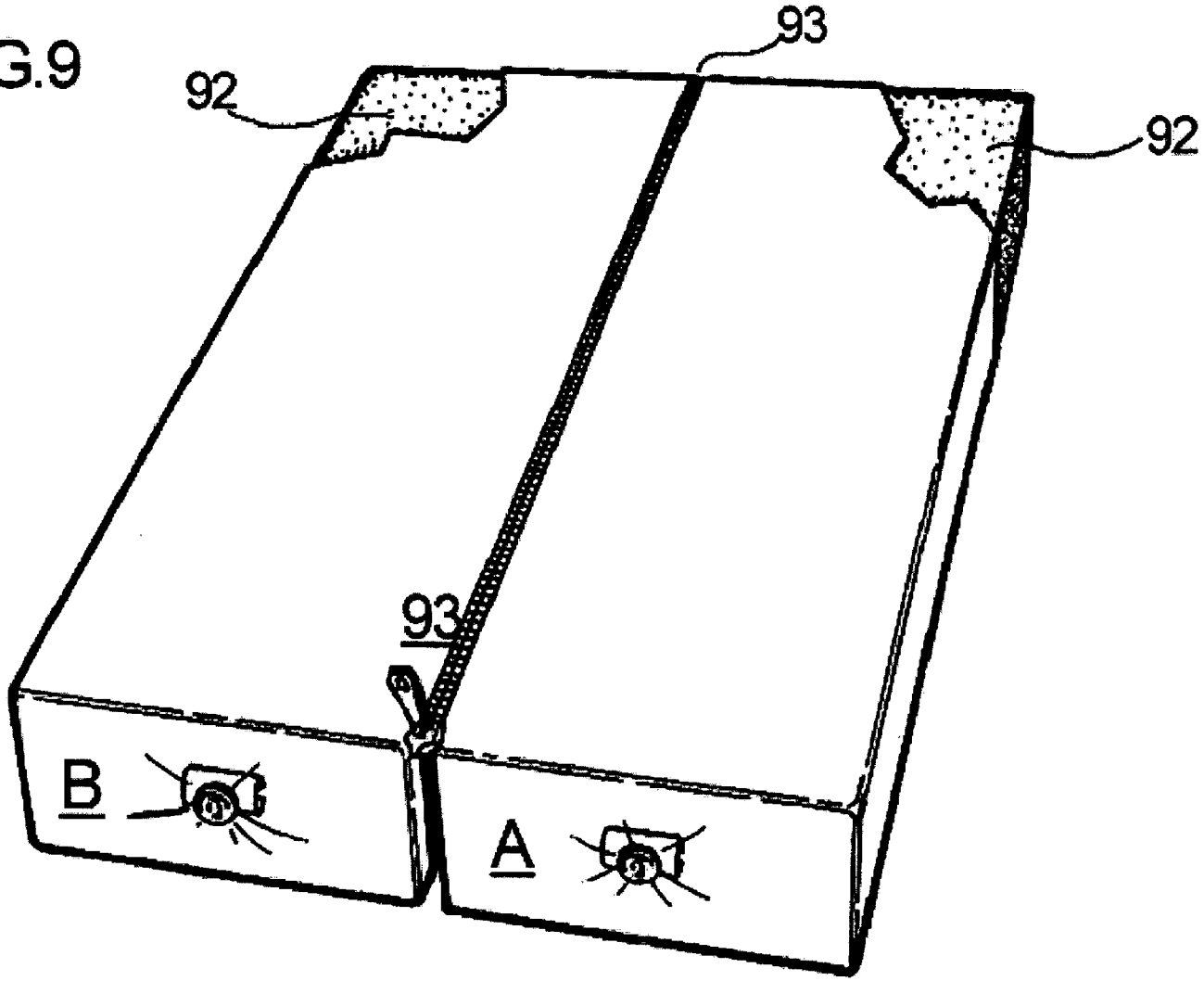
FIG. 9 shows two airtight autonomous chambers, one or more foam cores, an outer attachment, two valves and two distancing elements.
Figure 9A:
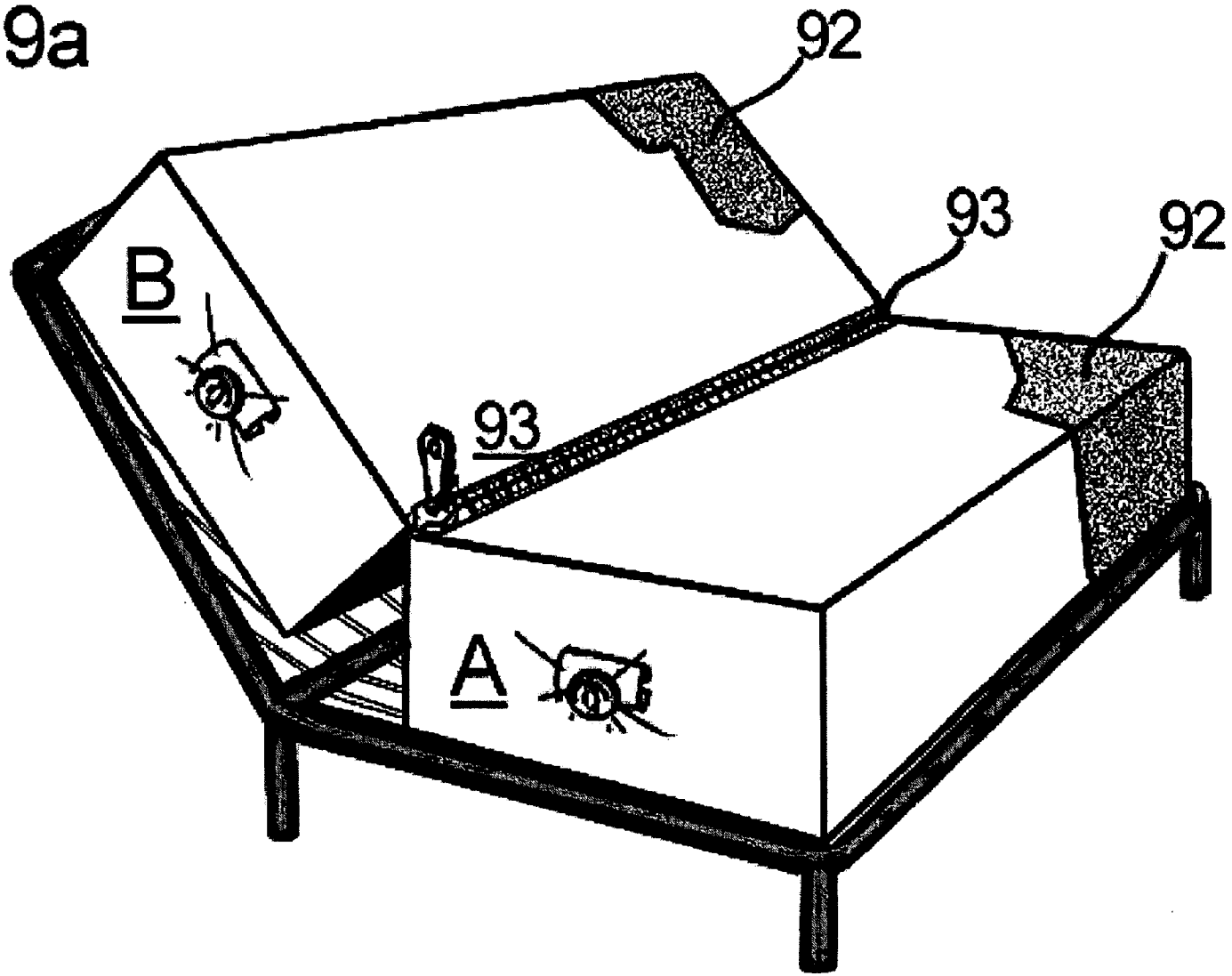
FIG. 9*a* shows the same mattress as in FIG. 8 with angled sections on a support frame.

FIG. 9 shows two airtight autonomous chambers (A and B) both containing one or more foam pieces (92). Both chambers (A and B) are removably connected by an exterior element (93) such as a zipper or hook and loop. Although the modulation capabilities of this mattress are identical to the previous in FIG. 8, it has the added advantage of separating into two mattresses which can be used in a different location. Moreover, as can be seen in FIG. 9*a*, both sections (A and B) may be inclined at different angles, if placed on an adjustable bed frame or on a futon bed frame.

Figure 10:
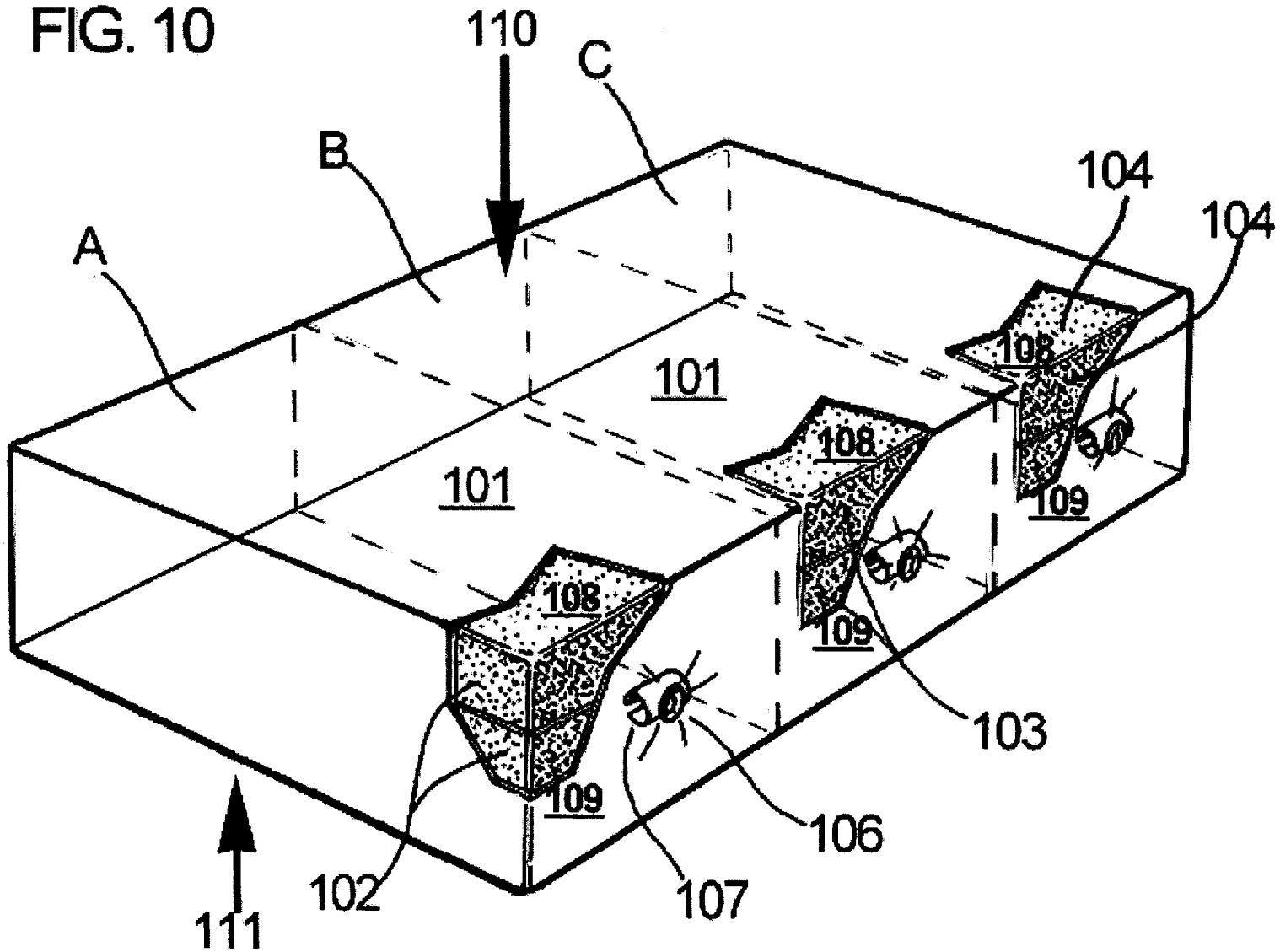
FIG. 10 shows three airtight autonomous chambers, one or more foam cores, two inner separations, three valves and three distancing elements.

FIG. 10 shows a three autonomous airtight chamber mattress (A,B,C) with two internal separations (101). Each chamber contains one or more foam pieces (102, 103, 104) to form three foam cores within the three chambers which may or may not contain foams of similar IFD and density ratings. Three chambers thus organized, represent a comfort zone for the head (A), middle body (B), and feet (C). Each section may be modulated by removing some air through the valves (106) (one shown) which each contains an air permeable distancing element (107) (one shown) directly behind it, to prevent any occlusion and to increase airflow to and from the chambers. The top foam pieces in chambers (A,B and C) (108) may be softer IFD factory-preset rated foam, and the bottom pieces (109) may be firmer factory-preset rated foams. In this manner, the user may chose to recline on either side of the mattress (arrows 110,111), before modulation with a vacuum pump is commenced.

Figure 11:
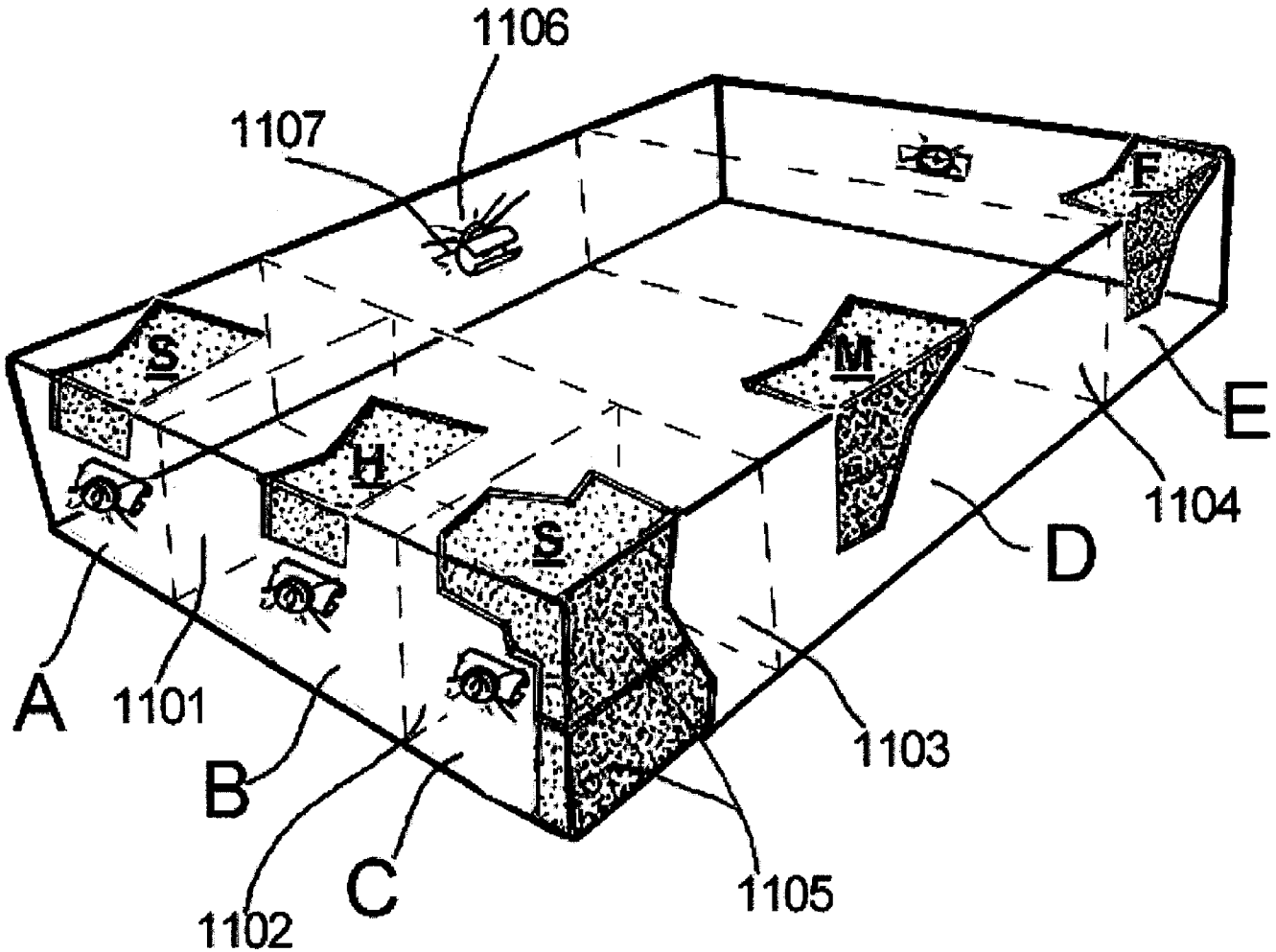
FIG. 11 shows five airtight autonomous chambers, one or more cores of foam in each chamber, four inner separations, five valves and five distancing elements.

FIG. 11 shows a five autonomous airtight chamber mattress (A,B,C,D and E) with four internal separations (1101–1104). Each chamber contains one or more foam pieces (1105) (only one foam core shown) to form five foam cores within the five chambers which may or may not contain foams of similar IFD and density ratings. Five chambers thus organized represent comfort zones for the head (H) and shoulders (S), middle body (M), and feet (F). Each chamber may be modulated by removing some air through the valves (1106) (one shown) which contains a permeable distancing element (1107) (one shown) directly behind it, to prevent any occlusion and to increase airflow to and from the chamber. As in FIG. 10, the top foam pieces in chambers (A,B C,D and E) may be softer IFD factory-preset rated foam, and the bottom pieces may be firmer. In this manner, the one may use the mattress on either side.

Figure 12:
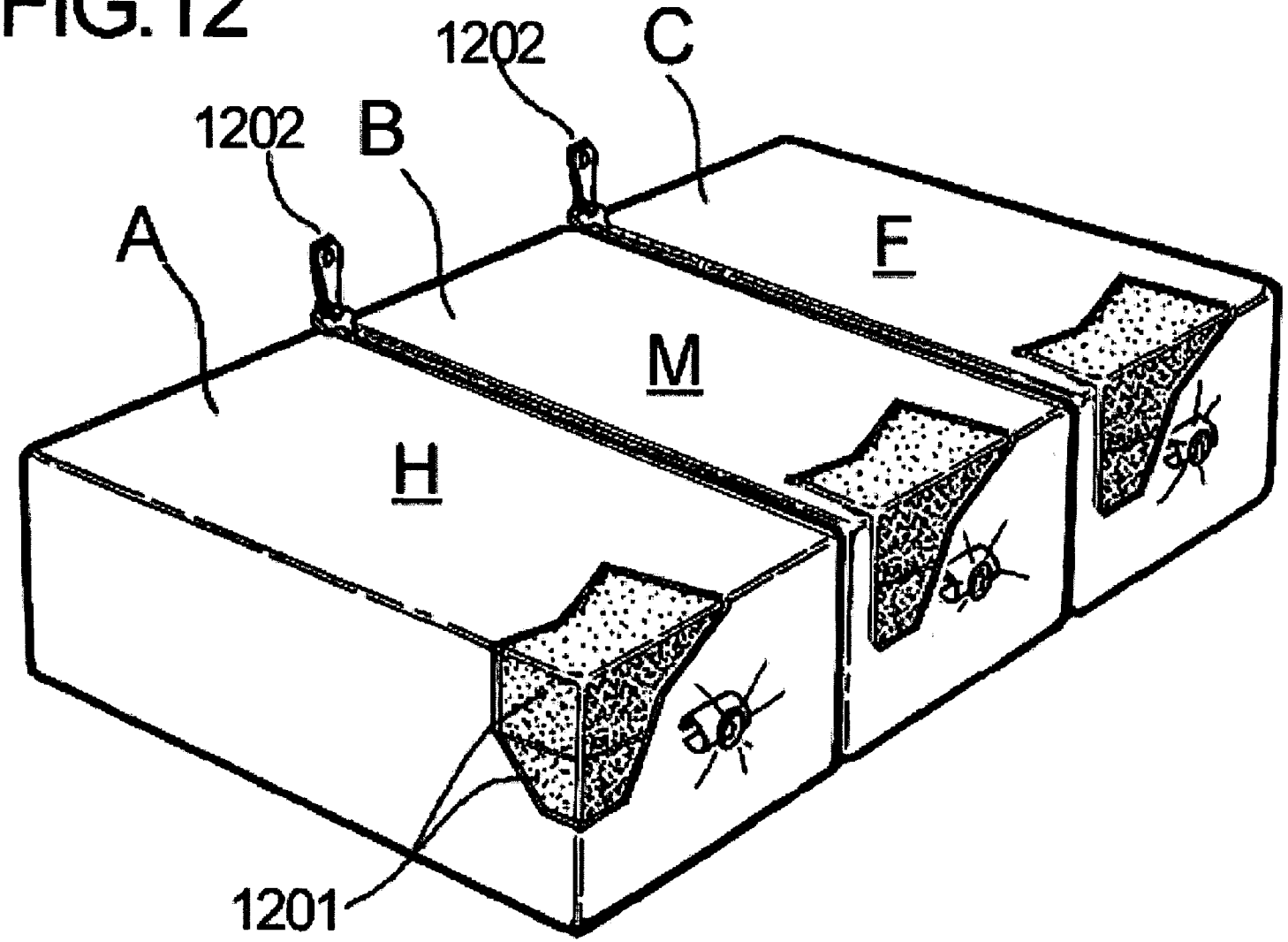
FIG. 12 shows three airtight autonomous chambers, a fastening element, one or more foam cores, three valves and three distancing elements.

FIG. 12 shows three autonomous airtight chambers (A, B and C) containing one or more foam pieces (1201) (only one core shown). All three chambers (A, B and C) are removably connected by an exterior element (1202) such as a zipper or hook and loop at the edges of the chambers. As with previous foam combinations, this mattress can be modulated by removing some air through the valves from either chamber resulting in a higher density, lower IFD more desirable foam feel. The chambers are zoned for head (H), middle body (M) or feet (F), and have the added advantage of separating into three sections. Moreover, both foot and head sections may be inclined at different angles if placed on an adjustable bed frame.

Figure 13:
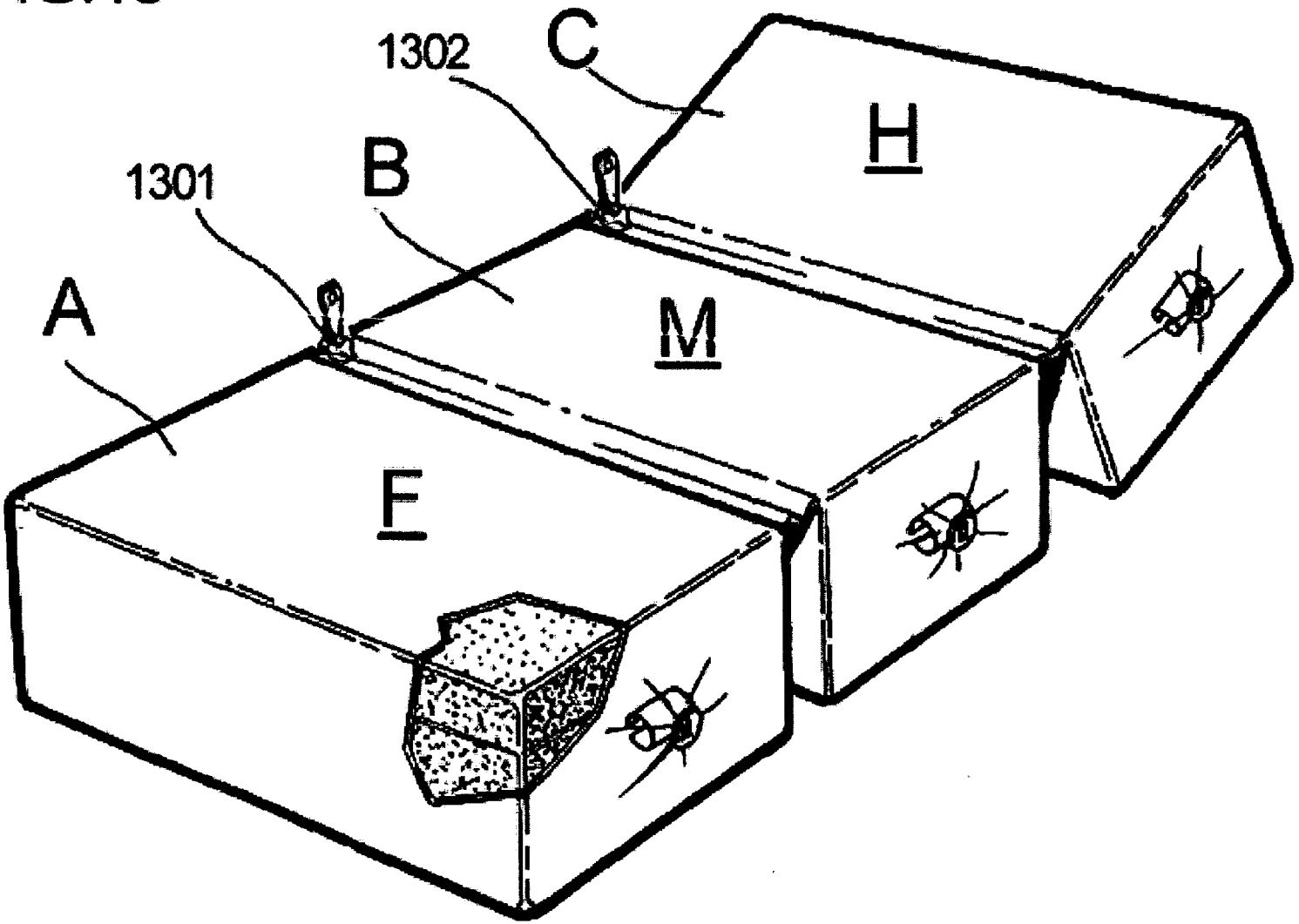
FIG. 13 shows three airtight autonomous chambers, fastening elements, one or more foam cores in each chamber, three valves and three distancing elements.

FIG. 13 shows a three autonomous airtight chamber mattress (A,B, and C) containing one or more foam pieces as in FIG. 12. The user has changed the order of (H, M and F ) to his preference using connecting zipper elements (1301 and 1302), and chamber C, the head section, has been angled upwards.

Figure 13B:
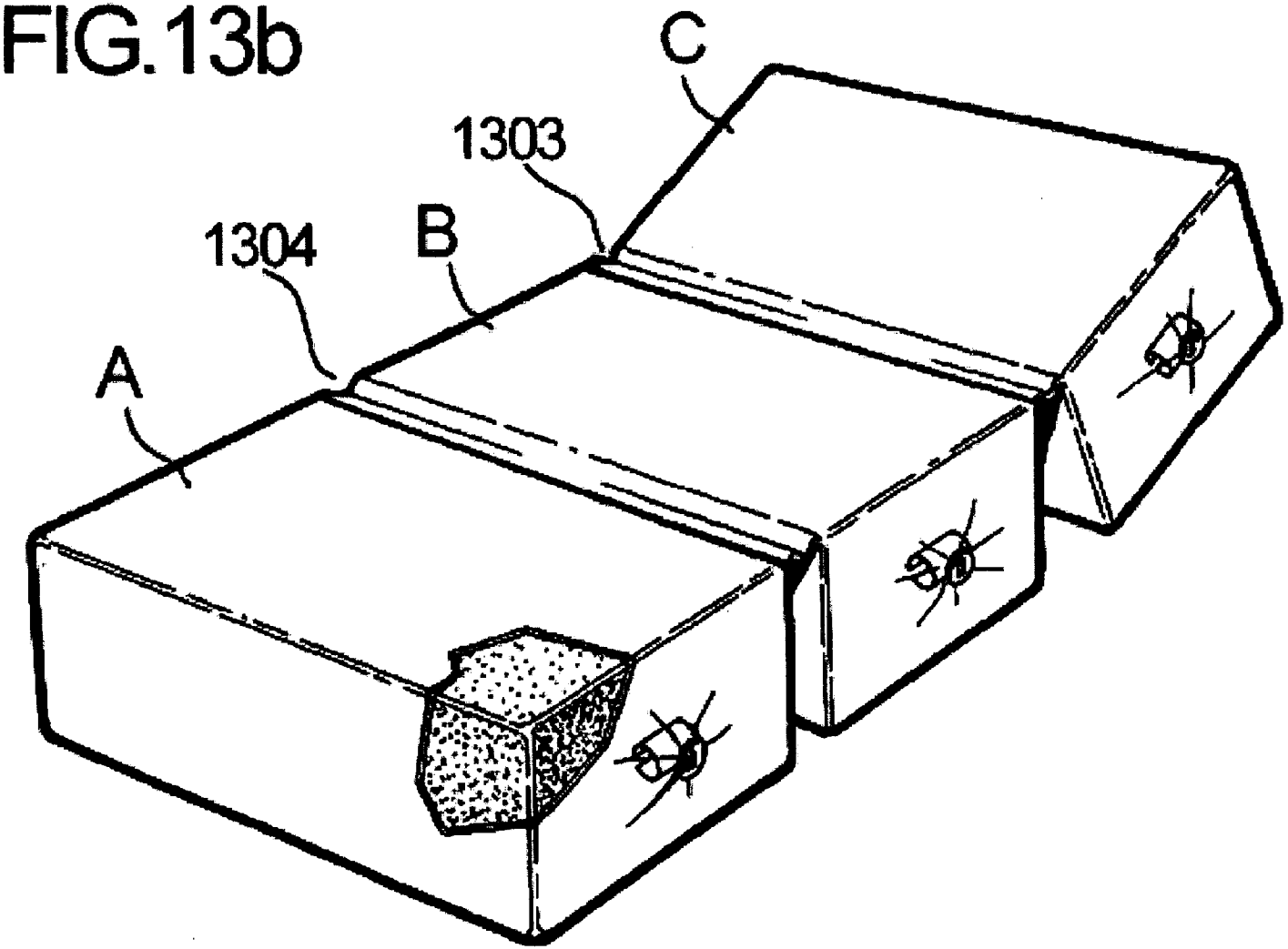
FIG. 13*b* shows three autonomous airtight chambers permanently attached together to form a sectional mattress.

FIG. 13*b* shows three autonomous airtight chamber (A,B, and C) which are permanently attached to each other to form a three sectional mattress. As mentioned previously, factory-preset foam types may vary enormously in density and IFD, ranging from 1.2 to 2.3 density with an IFD number from 22 to 55 before modulation. After modulation the foam density is at least doubled, and the IFD value drops considerably to simulate the tactile sensation of a high density low IFD foam such as visco-elastic foam—without incurring the associated penalties of high weight and high cost.

Figure 14:
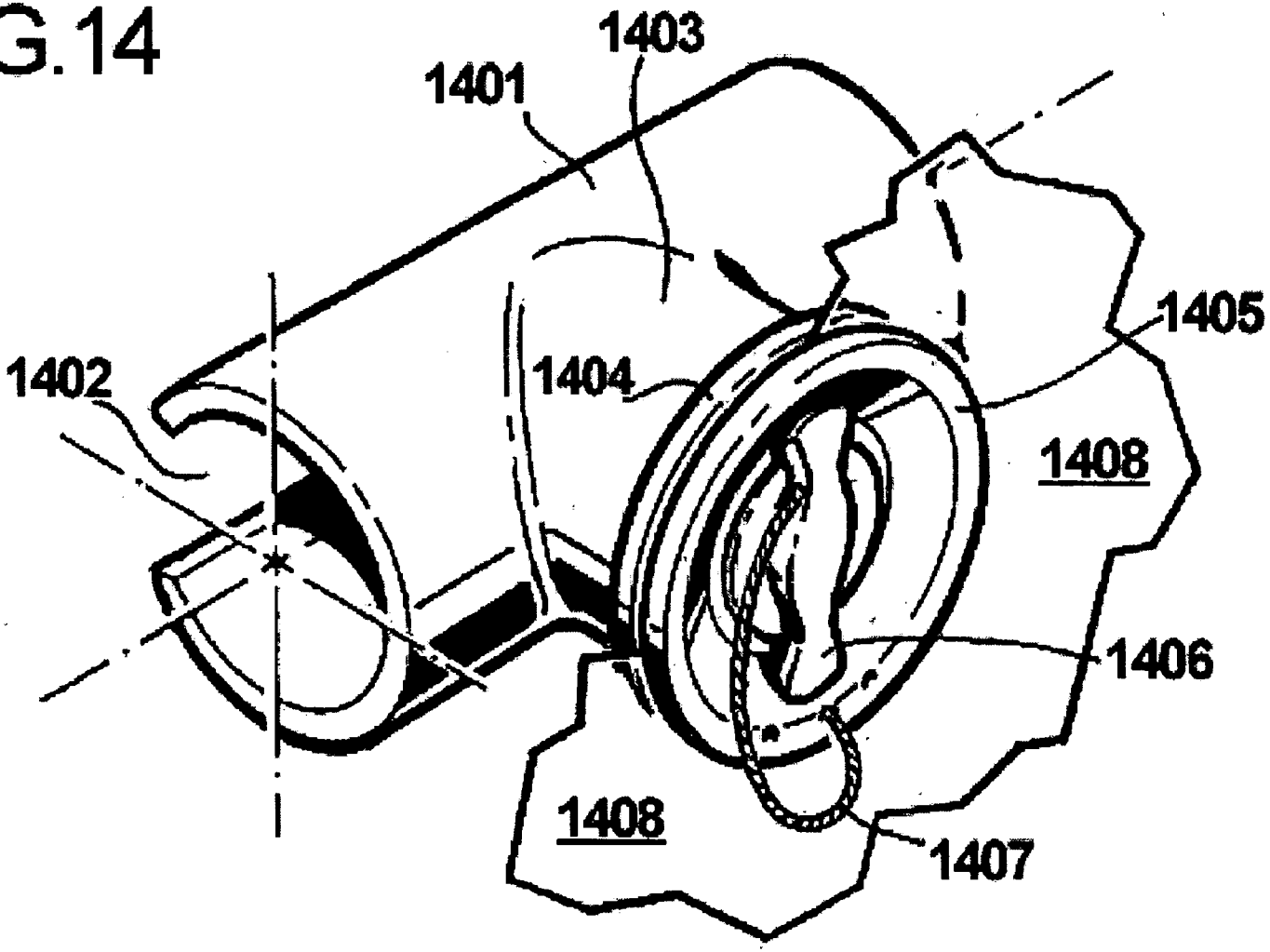
FIG. 14 shows an overall valve assembly installed in a chamber wall.

FIG. 14 shows the overall valve assembly as installed in the walls of any of the chambers referenced above, with an air permeable distancing element behind the valve. To this end, chamber wall (1408) is placed between two elements (1405 and 1404) of the overall valve assembly. The flange (1404) is a truncated, inverted cone as is more clearly shown in FIG. 17. Flange (1405) is also a truncated, but outward facing cone, which exactly matches inverted cone (1404) of FIG. 17. Once these elements are screwed together they will securely clamp the chamber wall. Welding or gluing can also be used as will be demonstrated further in FIG. 18, which is a more permanent installation, while a clamped valve could be taken apart again for servicing, if necessary. Also shown is a lateral cylindrical extension (1403) which interconnects to the valve and acts as an air-permeable distancing element (1401). The element has an air-permeable opening (1402), essential for the modulation of the foam core, since air can pass to and from the foam core. When air is rapidly evacuated through the assembly, foam and outer cover material is prevented from occluding or touching the valve, because the air-permeable distancing element keeps the foam and outer cover material at a distance from the inner valve. When not in use, the valve assembly can be closed by a plug (1406) which is inserted into the interior of the valve assembly. The plug is attached to the valve housing by a loss-prevention cord (1407). It also prevents any undesirable foreign particles or liquids from entering.

Figure 14B:
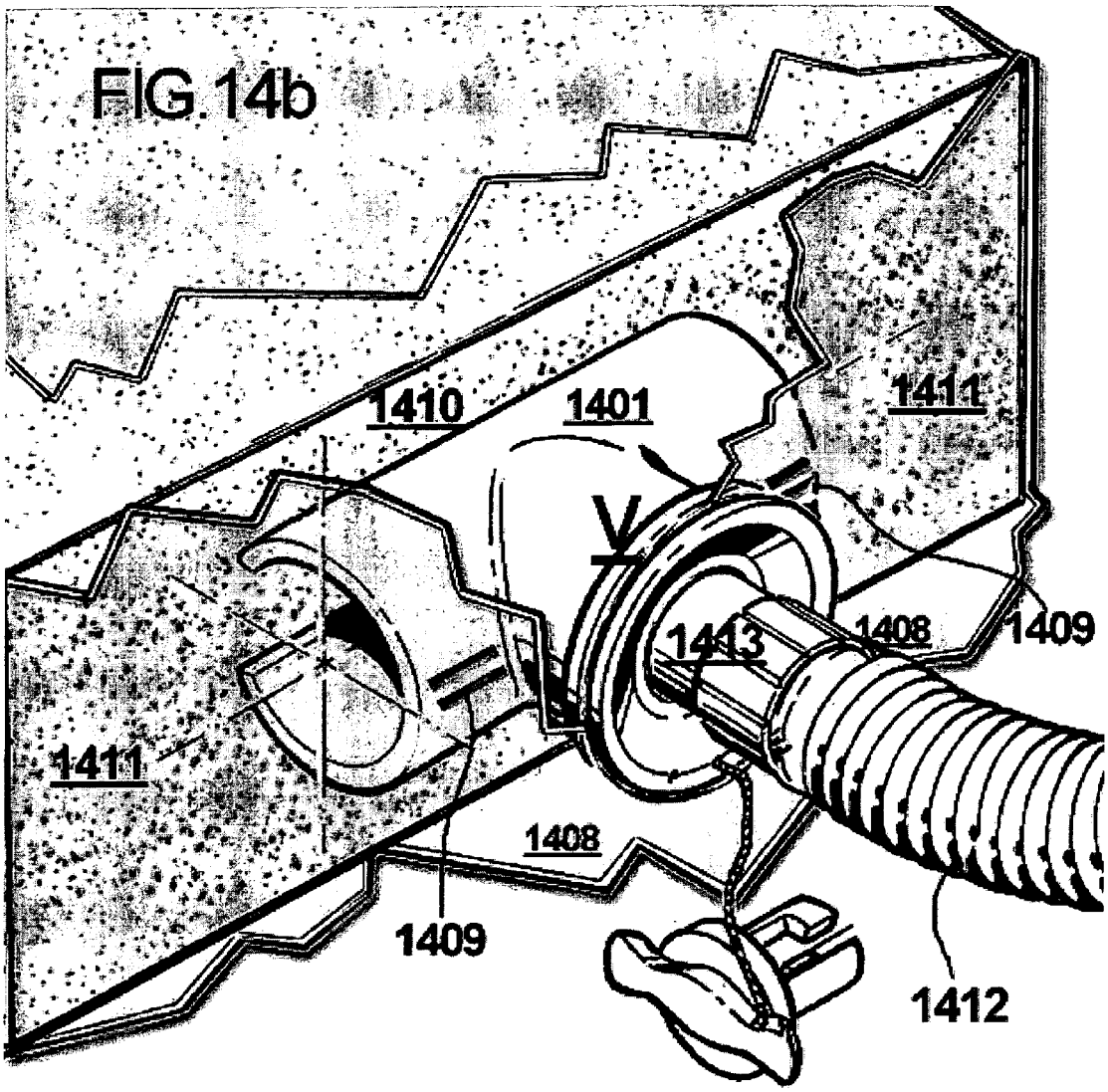
FIG. 14*b* shows a vacuum hose engaged in a valve with an air permeable distancing element behind the valve, and a foam core with an exploded outer cover.

FIG. 14*b* shows the air-permeable distancing element (1401) that may contain additional frontal openings (1409). When the vacuum is activated, air is drawn through the valve (V) and from within the foam core (1410). This causes the valve, distancing element (1401), and outer cover (1408) to be drawn towards the foam core (1410). By contrast, air also passes through openings (1409) from within the distancing element (1401), thus sucking the outer cover (1408) through the openings (1409) only in that area. The outer cover wall (1408) is pulled towards the openings (1409) and because of this vacuum effect the outer cover (1408) pulls the distancing element and the valve back towards itself. The two opposing forces (the valve and distancing element being pulled towards the foam, and the outer cover pulling these components back) allow for a perfect vacuuming effect to be formed and they create a perfect airflow. Thanks to this functionality the airflow within a vacuum pump is more efficient, causing less heat and fatigue to the electrical motor. It also increases the speed at which a mattress can be modulated. When a vacuum pump is activated to remove some air without an air-permeable distancing element, valve (V) and outer cover (1408 1411) would be drawn towards the foam wall (1410) and form a counter vacuum whereby very little air would be removed from the foam core. Also shown in FIG. 14*b* is a vacuum hose (1412) and nipple (1413 or 1507), which can be disengaged from the valve, or may be permanently attached to the valve extending towards a vacuum pump (not shown), and may be removably connected to that vacuum pump.

Figure 15:
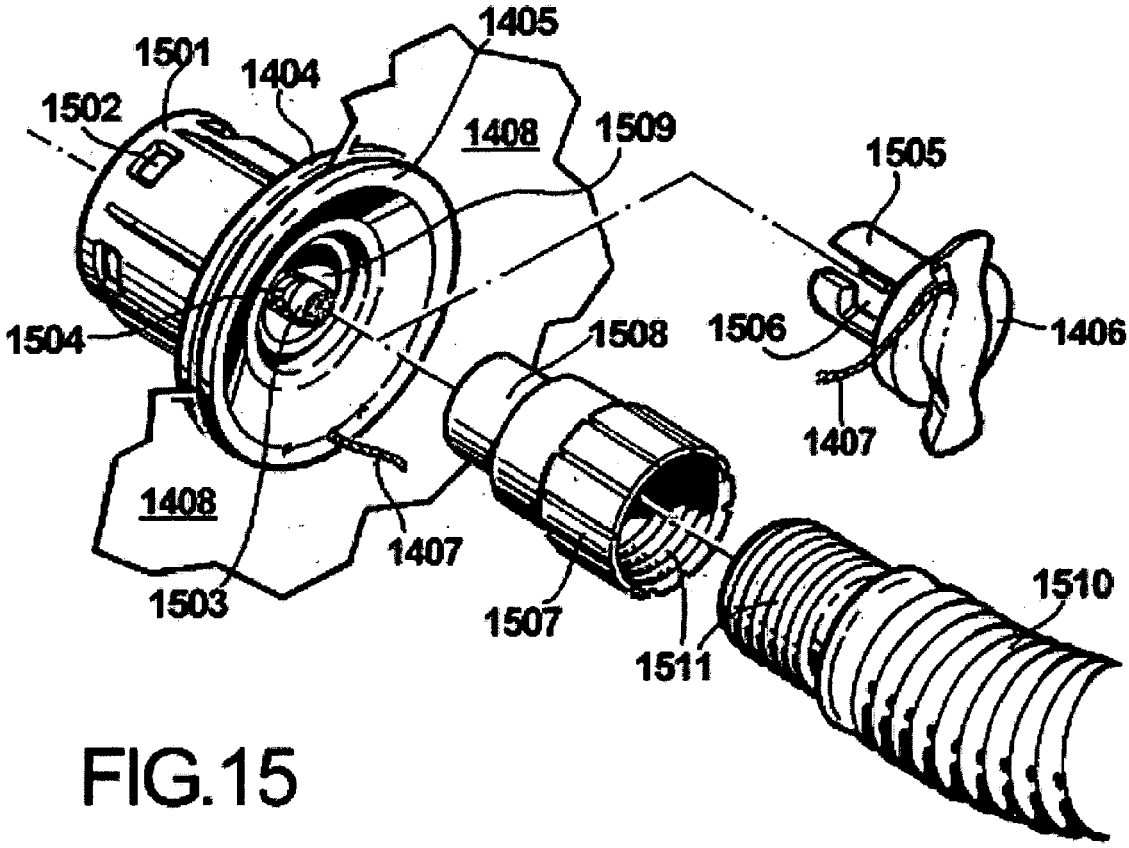
FIG. 15 shows an exploded view of the valve subassembly in combination with a vacuum hose.

FIG. 15 shows the structure of the valve assembly in an exploded view. The chamber material is clamped between flanges (1404) and (1405). Flange (1404) is connected to a cylindrical extension (1501), which has lateral air apertures (1502) so that the air being evacuated can easily enter the inner valve assembly. The cylindrical extension (1501) fits tightly within the air-permeable distancing element and extends laterally (1401). Behind the valve stem-head (1503) is a compression spring (1504) and a protective plug (1406), which has a forward cylindrical extension (1505) with a locking slot (1506), allowing plug (1406) to be engaged into interior receptacle (1509). When air is evacuated from any of the chambers referenced above, plug (1406) is removed from the valve assembly and nipple (1507) is being inserted into the interior receptacle (1509) with its forward end (1508) in a press fitting manner. A vacuum hose (1510) is attached to the nipple (1507) by way of screw threads (1511).

Figure 16:
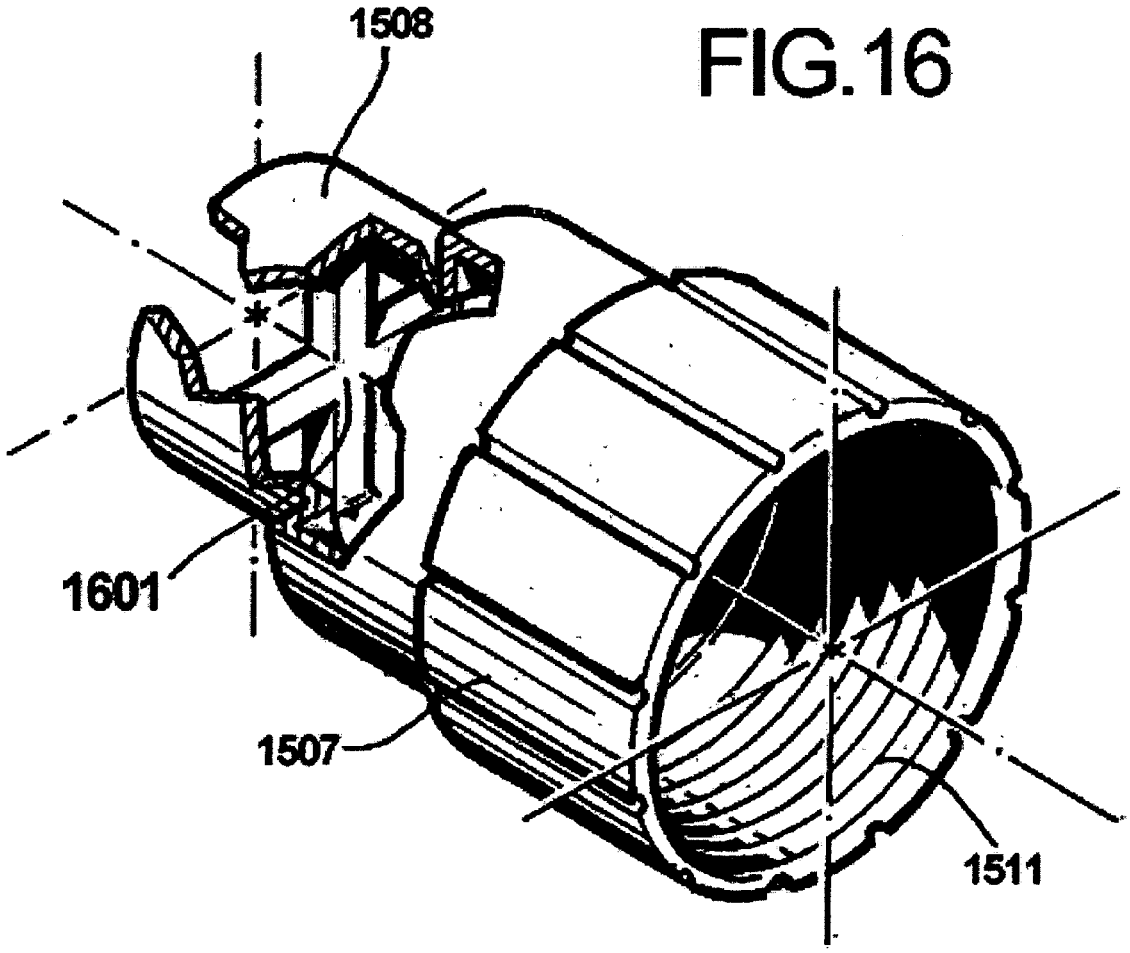
FIG. 16 shows details of a valve element.

FIG. 16 shows details of nipple (1507) in a broken-away view. Inside the cylindrical extension sits an activator element (1601) in the form of a cross. When the cylindrical extension (1508) is pushed into interior receptacle (1509) for the purpose of evacuating air, cross (1601) inside extension (1508) will engage valve stem-head (1503) of FIG. 15 and thereby push valve stem (1703) of FIG. 17 further into the valve assembly. Note: while the valve subassembly (1405) is shown in cross section for clarity's sake, valve stem (1703) and valve seating plate (1706) with its seal are not.

Figure 17:
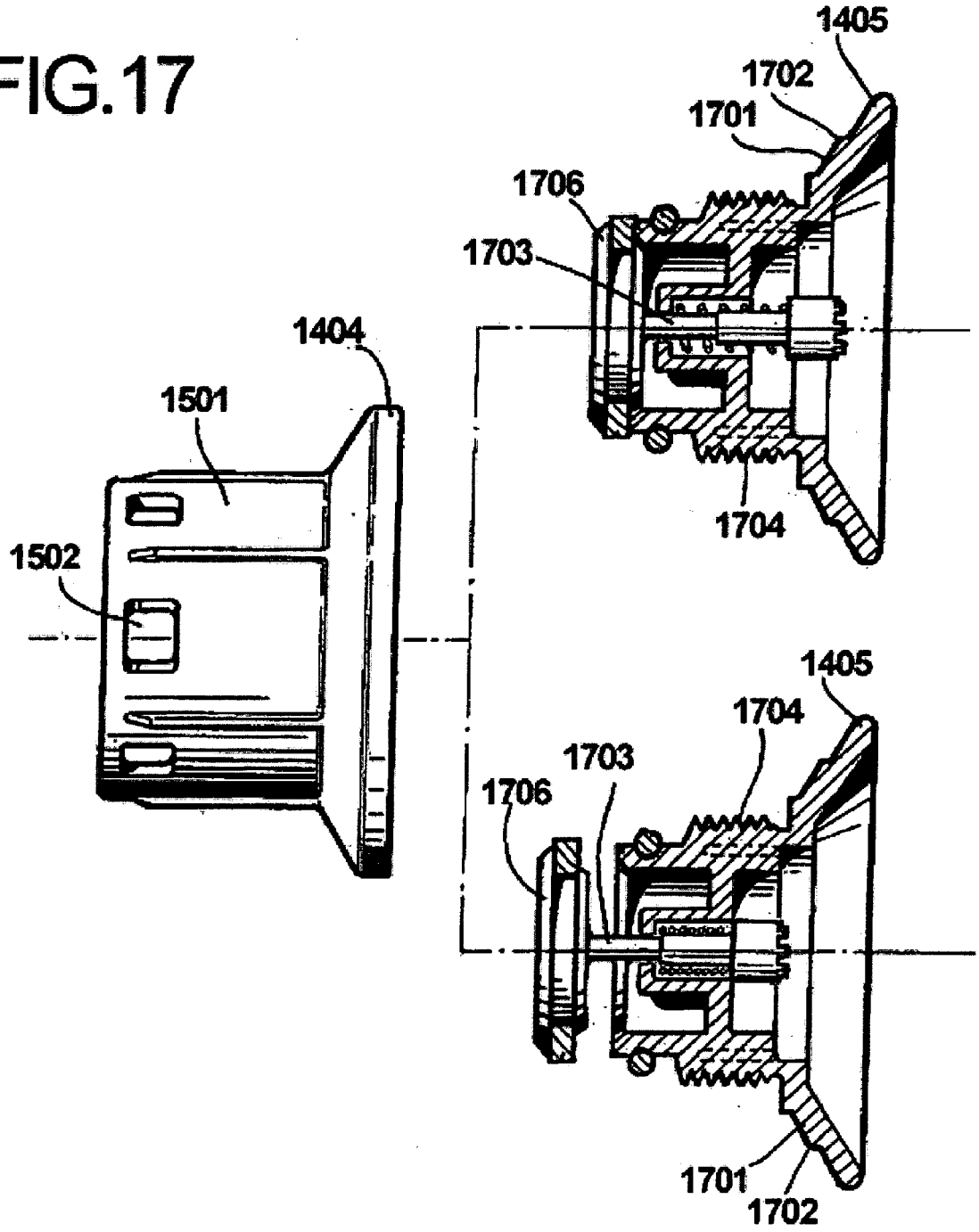
FIG. 17 shows operation of valve subassembly.

FIG. 17 shows the valve subassembly in open and closed positions as they will be contained within the cylindrical extension (1501). Both threaded inserts (1704) with threaded flanges (1405) are inserted into like threads (not shown) in extension (1501). The flanges (1405) have slanted faces (1701) with clamping ridges (1702), which make sure that the chamber walls (1408) are secured after having been screwed into the inverted flange (1404) of extension cylinder (1501). Valve spring (1504) is designed with different pre-set closure-forces raging from 2 lbs to 6 lbs, to balance the re-inflating forces of the foam cores, thus preventing a completely deflated foam core to suffer from the phenomenon of compression set after an extended time of complete deflation.

Figure 18:
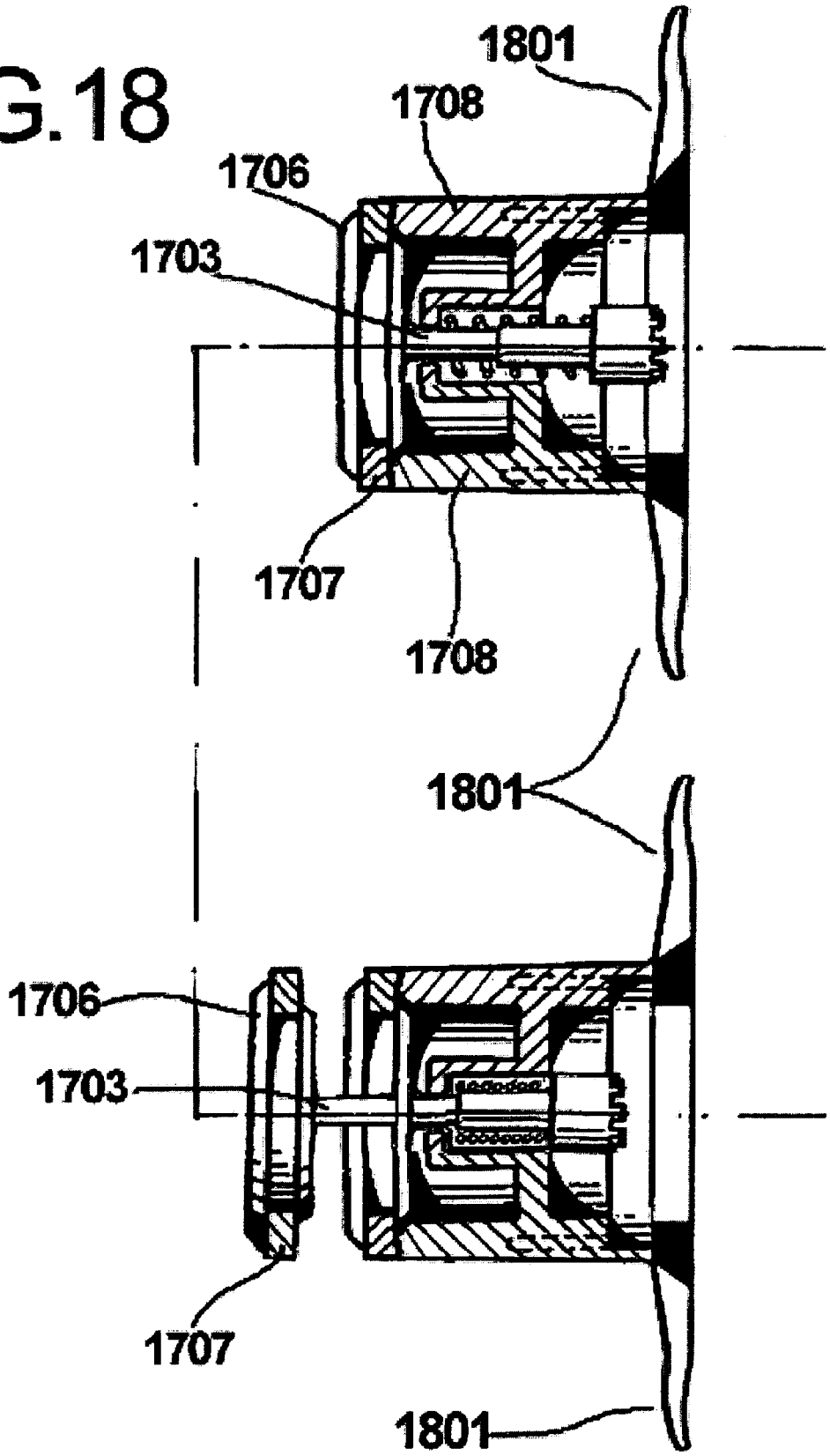
FIG. 18 shows a valve with soft plastic flange for welding.

FIG. 18 shows another valve model which is in open and closed position. The difference between this valve and the previous valve of FIG. 17 is that this valve comes equipped with a plastic flange (1801) that can be welded and sealed to outer cover (1408). The valve's rear body (1708) also connects to the air-permeable distancing element (1401) to ensure an efficient removal of air from the foam cores and mattress chambers, be it for modulation or for transport and storage.

What we claim is:

1. A cushioning apparatus adapted to cushion objects placed on either surface of said apparatus, said apparatus including one or more pieces of open cell self-inflating flexible polyurethane foam to form a foam core, said foam core is covered by one or more hermetically sealed envelopes forming one or more autonomous airtight chambers, means for controlling and modulating the principal characteristics of said open cell self-inflating flexible polyurethane foam, said means comprising means for removing some air uniformly from within said open foam cells to change the softness and support ratio within the foam core, said means for removing said air from said foam core including one or more valves installed in said chamber walls that are removably connected to a vacuum pump by way of a hose;

said apparatus including one or more foam pieces combined to form one or more foam cores, said cores may have different factory preset density and IFD ratings and further combined into autonomous airtight chambers within said apparatus.

2. The apparatus for claim 1 wherein said means for removing some air results in altering the cellular density of said foam core.

3. The apparatus of claim 2, wherein said means for removing some air results in increasing the cellular density of said foam core.

4. The apparatus of claim 1, wherein said foam core can an IFD value within a range of 22 to 50 in its original factory pre-set configuration and a progressively decreasing value when some air is removed from said core.

5. The apparatus of claim 1, wherein said foam core has a density within a range of 1.2 to 2.5 pounds per cubic foot in its original, factory pre-set configuration, and a progressively increasing density when some air is removed from said foam core, without adding weight to the overall apparatus.

6. The apparatus of claim 5, wherein the foam core exhibits a diminishing density and an increasing IFD value when allowed to self-inflate from a collapsed state.

7. The apparatus of claim 1, wherein said foam core has a thickness of at least four inches in a fully self-inflated state to be able to fully achieve the characteristics of said modulation.

8. The apparatus of claim 1, including means for distancing said valve in said chamber from any adjacent materials that may obstruct airflow.

9. The apparatus of claim 8, wherein said means for distancing is air-permeable and contiguous with said foam material within the chamber.

10. The apparatus of claim 8 in which said means for distancing includes a cylindrical extension element connected communicably and extending axially laterally to said valve and having an air permeable opening for keeping said foam core and said envelope at a distance from said valve to prevent said core and envelope from occluding said valve.

11. The apparatus of claim 1, including one or more foam pieces, combined to form one or more foam cores, said cores may have identical factory pre-set density and IFD ratings and are further combined into autonomous airtight chambers within said apparatus.

12. The apparatus of claim 11 wherein each of said autonomous airtight chambers has one or more valves located in a wall of each of said chambers with an air permeable distancing element interconnected to said valves.

13. The apparatus of claim 1, wherein each of said autonomous airtight chambers has one or more valves located in a wall of each of said chambers with an air-permeable distancing element interconnected to said valves.

14. The apparatus of claim 1, whereby a partially deflated foam core contained within an autonomous airtight chamber, having a closed valve, recovers slowly when a weight placed upon said chamber is removed, thereby exhibiting the principal characteristics of visco-elastic foam.

15. The apparatus of claim 14, whereby further deflation of a partially deflated foam core contained within an autonomous airtight chamber, having a closed valve, exhibits no upward recovery thereby exhibiting less upward pressure than visco-elastic foam.

16. The apparatus of claim 1, wherein the self-inflating foam core adjusts to pressure points only locally without creating a hammock. effect.

17. The apparatus of claim 1, wherein each of said autonomous airtight chambers may be permanently attached to each other to form a sectional mattress.

18. The apparatus of claim 1, wherein each of said autonomous airtight chambers may be removably connected to each other at the exterior edges of said chamber.

19. The apparatus of claim 1, wherein each of said autonomous airtight chambers when combined into a mattress or support apparatus, may be used on either side before modulation is commenced.

20. A cushioning apparatus adapted to cushion objects placed on either surface of said apparatus, said apparatus including one or more pieces of open cell self-inflating flexible polyurethane foam to form a foam core, said foam core is covered by one or more hermetically sealed envelopes forming one or more autonomous airtight chambers, means for controlling and modulating the principle characteristics of said open cell self-inflating flexible polyurethane foam, said means comprising means for removing some air uniformly from within said open foam cells to change the softness and support ratio within the foam core, said means for removing said air from said foam core including one or more valves installed in said chamber walls that are removably connected to a vacuum pump by way of a hose; and a pressure-balanced closure spring located in said valve.

21. The apparatus of claim 20, including a means for opening and closing said valve and said closure spring.

22. The apparatus of claim 21, including means for opening said valve by a hose, which is permanently attached to said valve but removably connected to said vacuum pump.

23. The apparatus of claim 20, including a closure force of said spring which equals the re-inflating force of said foam core when said foam core is in a partially inflated state so that no more air can enter said foam core.

24. The apparatus of claim 20, wherein said pressure-balanced closure force of said spring is within a range of 2 lb. to 6.0 lb.

25. A cushioning apparatus adapted to cushion objects placed on either surface of said apparatus, said apparatus including one or more pieces of open cell self-inflating flexible polyurethane foam to form a foam core, said foam core is covered by one or more hermetically sealed envelopes forming one or more autonomous airtight chambers, means for controlling and modulating the principle characteristics of said open cell self-inflating flexible polyurethane foam, said means comprising means for removing some air uniformly from within said open foam cells to change the softness and support ratio within the foam core, said means for removing said air from said foam core including one or more valves installed in said chamber walls that are removably connected to a vacuum pump by way of a hose; and a pressure-balanced closure spring located in said valve, said spring including a closure force which opposes a re-inflating force of the foam core, said opposing force being weaker than the re-inflating force of said foam core in its collapsed state, whereby some air can re-enter said foam core to avoid the risk of compression set inherent in a totally collapsed foam, collapsed over a certain period of time.

26. A cushioning apparatus adapted to cushion objects placed on either surface of said apparatus, said apparatus including one or more pieces of open cell self-inflating flexible polyurethane foam to form a foam core, said foam core is covered by one or more hermetically sealed envelopes forming one or more autonomous airtight chambers, means for controlling and modulating the principle characteristics of said open cell self-inflating flexible polyurethane foam, said means comprising means for removing some air uniformly from within said open foam cells to change the softness and support ratio within the foam core, said means for removing said air from said foam core including one or more valves installed in said chamber walls that are removably connected to a vacuum pump by way of a hose; and further including means for distancing said valve in said chamber from any adjacent materials that may obstruct airflow, said means for distancing being air-permeable and contiguous with said foam material within said chamber.

27. The apparatus of claim 26, wherein said air-permeable distancing element is communicably attached to said valve at a point which is opposite to said foam material.

28. The apparatus of claim 27, wherein said air-permeable distancing element acts as a means to increase inflation and deflation speed as well as the air quantity to and from the apparatus and into a vacuum pump.

29. A cushioning apparatus adapted to cushion objects placed on either surface of said apparatus, said apparatus including one or more pieces of open cell self-inflating flexible polyurethane foam to form a foam core, said foam core is covered by one or more hermetically sealed envelopes forming one or more autonomous airtight chambers, means for controlling and modulating the principle characteristics of said open cell self-inflating flexible polyurethane foam, said means comprising means for removing some air uniformly from within said open foam cells to change the softness and support ratio within the foam core, said means for removing said air from said foam core Including one or more valves installed an said chamber walls that are removably connected to a vacuum pump by way of a hose; and further including means for distancing said valve in said chamber from any adjacent materials that may obstruct airflow, said means for distancing including a cylindrical extension element connected communicably and extending axially laterally to said valve and having an air-permeable opening for keeping said foam core and said envelope at a distance from said valve to prevent said core and envelope from occluding said valve.

* * * * *